US008017004B2

(12) United States Patent
Crumpler

(10) Patent No.: US 8,017,004 B2
(45) Date of Patent: Sep. 13, 2011

(54) STORM DRAIN AND FILTER SYSTEM

(75) Inventor: John M. Crumpler, Raleigh, NC (US)

(73) Assignee: Trash Guard, Inc., Roseboro, NC (US)

( * ) Notice: Subject to any disclaimer, the term of this patent is extended or adjusted under 35 U.S.C. 154(b) by 120 days.

(21) Appl. No.: 12/542,079

(22) Filed: Aug. 17, 2009

(65) Prior Publication Data

US 2009/0301953 A1 Dec. 10, 2009

Related U.S. Application Data

(63) Continuation-in-part of application No. 12/402,122, filed on Mar. 11, 2009, now abandoned, which is a continuation-in-part of application No. 11/854,930, filed on Sep. 13, 2007, now Pat. No. 7,534,355, which is a continuation-in-part of application No. 11/138,947, filed on May 26, 2007, now Pat. No. 7,276,156.

(51) Int. Cl.
*E03F 5/14* (2006.01)

(52) U.S. Cl. ..... 210/155; 210/162; 210/170.03; 210/236; 210/498

(58) Field of Classification Search ..... 210/154, 210/155, 162, 163, 164, 170.03, 236, 238, 210/323.1, 498
See application file for complete search history.

(56) References Cited

U.S. PATENT DOCUMENTS

| | | | | | |
|---|---|---|---|---|---|
| 1,693,977 | A * | 12/1928 | Egan | 210/163 |
| 1,793,080 | A * | 2/1931 | Glover | 210/236 |
| 2,986,232 | A * | 5/1961 | Wiley | 210/459 |
| 3,282,430 | A * | 11/1966 | Kinne | 210/162 |
| 4,689,145 | A * | 8/1987 | Mathews et al. | 210/170.03 |
| 5,736,035 | A * | 4/1998 | Nurse, Jr. | 210/498 |
| 6,126,817 | A * | 10/2000 | Duran et al. | 210/154 |
| 6,214,217 | B1 * | 4/2001 | Sliger, Jr. | 210/232 |
| 7,276,156 | B2 | 10/2007 | Lockerman et al. | |
| 7,300,590 | B2 * | 11/2007 | Weir et al. | 210/170.03 |
| 7,534,355 | B2 | 5/2009 | Lockerman et al. | |
| 7,722,763 | B2 * | 5/2010 | Benty et al. | 210/162 |
| 7,815,800 | B2 * | 10/2010 | Komatsu | 210/232 |
| 2006/0091049 | A1 * | 5/2006 | Hurst et al. | 210/163 |
| 2010/0147756 | A1 * | 6/2010 | Duran et al. | 210/170.03 |

* cited by examiner

*Primary Examiner* — Christopher Upton
(74) *Attorney, Agent, or Firm* — Coats & Bennett, P.L.L.C.

(57) ABSTRACT

A filter system for a storm drain having a bottom, side walls, and an outlet formed in the side wall. The filter system includes a main section having an array of openings formed therein for permitting water to flow through the filter. The main section is configured to be mounted adjacent the side wall and aligned with the outlet. In some cases, the bottom of the storm drain includes a depression for feeding water to the outlet. The filter system includes a flexible mesh that extends from the bottom of the main section into the depression for filtering water flowing in the depression. In addition, the filter system includes a mounting structure that enables the main section to be slidably mounted into an operative position and also enables the main section to be removed by slidably moving it from the operative position.

19 Claims, 19 Drawing Sheets

STORM DRAIN AND FILTER SYSTEM

CROSS REFERENCE TO PROVISIONAL APPLICATION

The present application is a continuation-in-part of U.S. patent application Ser. No. 12/402,122 filed Mar. 11, 2009; which is a continuation-in-part of Ser. No. 11/854,930, filed Sep. 13, 2007, now U.S. Pat. No. 7,534,355; which was in turn a continuation-in-part of U.S. patent application Ser. No. 11/138,947, filed May 26, 2005, now U.S. Pat. No. 7,276,156. The disclosures of these applications and patents are expressly incorporated by reference.

FIELD OF THE INVENTION

The present invention relates to storm drains, and more particularly to a filter system for filtering trash and debris from water that has entered a storm drain.

BACKGROUND OF THE INVENTION

Storm drains provide an important function in directing rain and storm water from residential, commercial and industrial areas. Typically a storm drain includes a compartment or a housing structure that sits below grade and typically includes a bottom, a surrounding side wall, an inlet and an outlet. Typically the inlet of a storm drain is provided along a street or roadway curb. Storm drains are strategically located with respect to the surrounding elevation of land and paved areas such that water resulting from storm or rain showers will gravitate to the storm drain inlet. Of course, rain and storm water will be directed into the inlet but also trash, debris, leaves, limbs and other vegetation tend to be caught up in the flow of water and are also directed into the storm drains. This trash, debris and other unwanted objects and materials can cause serious problems. First, the debris, trash and the like tend to accumulate in the bottom of the storm drain and interfere with the flow of water through the storm drain. Eventually this debris and trash enters the storm drain outlet and is flushed into streams, creeks, rivers and other waterways.

One of the challenges in filtering debris and trash from storm water passing through the storm drain is designing a filter system or assembly that is compatible with the storm drain. An examination of storm drains across the United States reveals that their designs are not consistent. They are not all the same size and the layout and design vary from location to location. Specifically, it is not uncommon to find storm drains where the side walls and the bottom are not uniform. For example, it is common practice to provide a depression in the bottom of the storm drain in the vicinity of the outlet. This depression channels or feeds water into the outlet. This depression, however, will vary from storm drain to storm drain in terms of length, width, and depth. This is problematic because in order to efficiently filter the water flowing to and through the outlet, the filter applied must conform to these irregularities and provide screening for the entire volume of water being directed to the outlet.

Therefore, there has been and continues to be a need for a filtering system or filter assembly for a storm drain that is sufficiently flexible in design such that the filter assembly as a whole is able to conform to irregularities in the structure of the storm drain and efficiently filter the entire flow of water directed to the outlet.

SUMMARY OF THE INVENTION

The present invention relates to a filter for use in a storm drain. The filter includes a panel or main section that includes an array of openings and which is designed or configured to be positioned adjacent an outlet formed in the side wall of the storm drain. In addition the filter includes a flexible mesh that is disposed adjacent the panel or main section of the filter. The flexible mesh in one example extends adjacent the bottom of the panel or main section and into a depression formed in the bottom of the storm drain. Thus, the flexible mesh filters water passing through the depression towards the outlet. The panel or main section in combination with the flexible mesh generally filters a majority or a substantial portion of the water flowing through the storm drain and into the outlet.

In another embodiment of the present invention, the filtering device for use in a storm drain is provided with a mounting assembly that enables the panel or main section to be easily mounted adjacent the side wall of the storm drain. In this embodiment, there is provided a mounting assembly that comprises a pair of flanges and a pair of elongated slots. To mount the filter adjacent the side wall, the flanges are aligned with the slots and the filter slides to an operative positioned adjacent the outlet of the storm drain. To remove the filter, the panel or main section of the filter is raised, resulting in the flanges sliding through the slots.

Other objects and advantages of the present invention will become apparent and obvious from a study of the following description and the accompanying drawings which are merely illustrative of such invention.

DESCRIPTION OF EXEMPLARY EMBODIMENTS

With further reference to the drawings, the filter of the present invention is shown therein and indicated generally by the numeral 10. As will be discussed subsequently herein, filter 10 is designed to be installed in a storm drain indicated generally by the numeral 50 and shown schematically in FIGS. 4 and 5. Prior to describing the installation of the filter 10 within the storm drain 50, the filter itself will be described.

Figure 2:
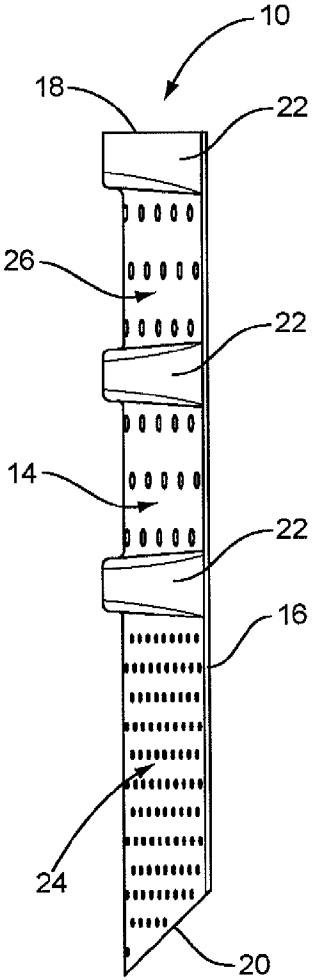
FIG. 2 is a side elevational view of the filter.
Figure 1:
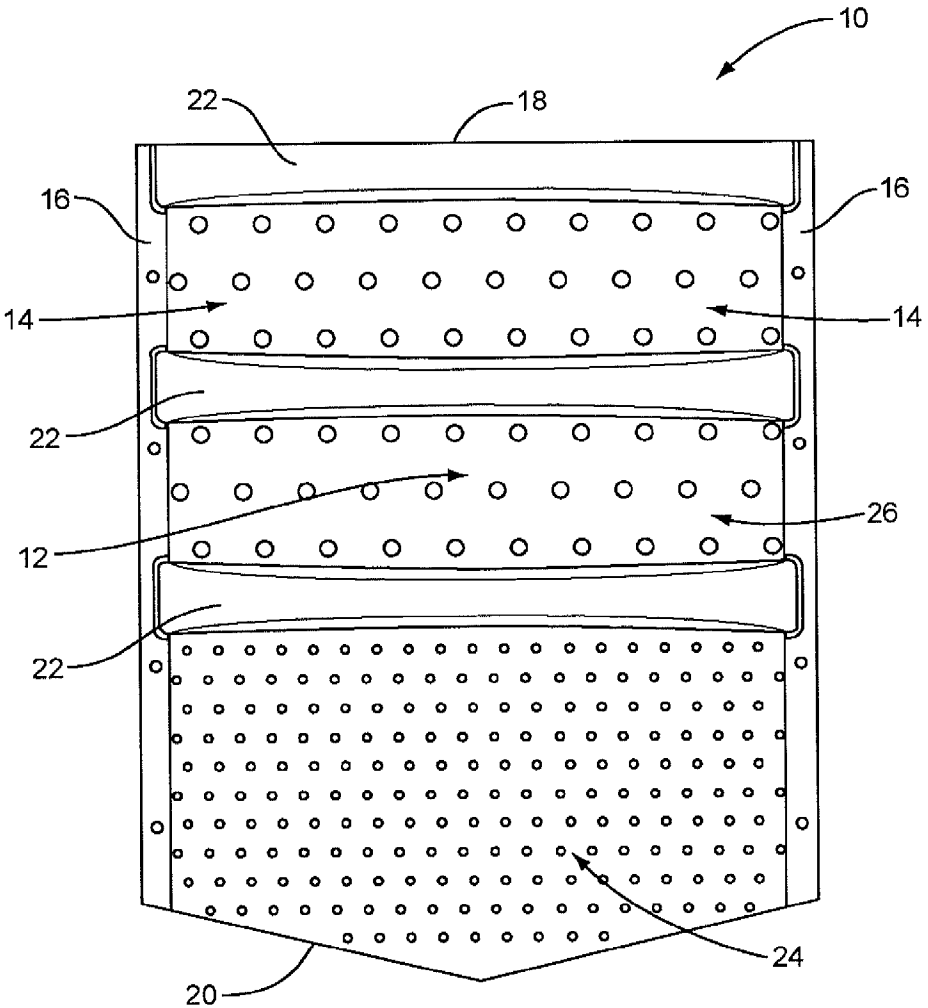
FIG. 1 is an elevational view of the filter of the present invention.
Figure 3:
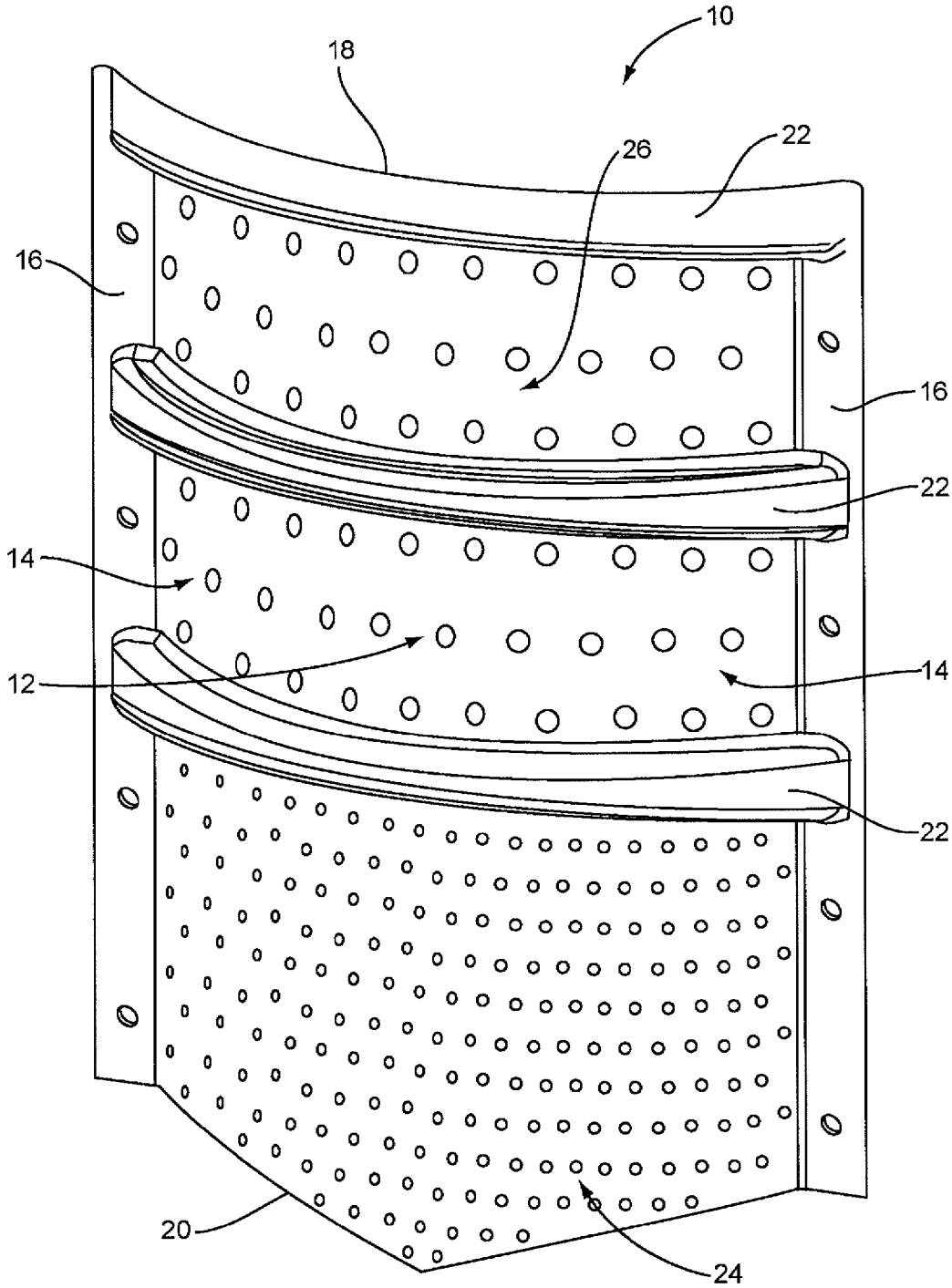
FIG. 3 is a perspective view of the filter.
Figure 4:
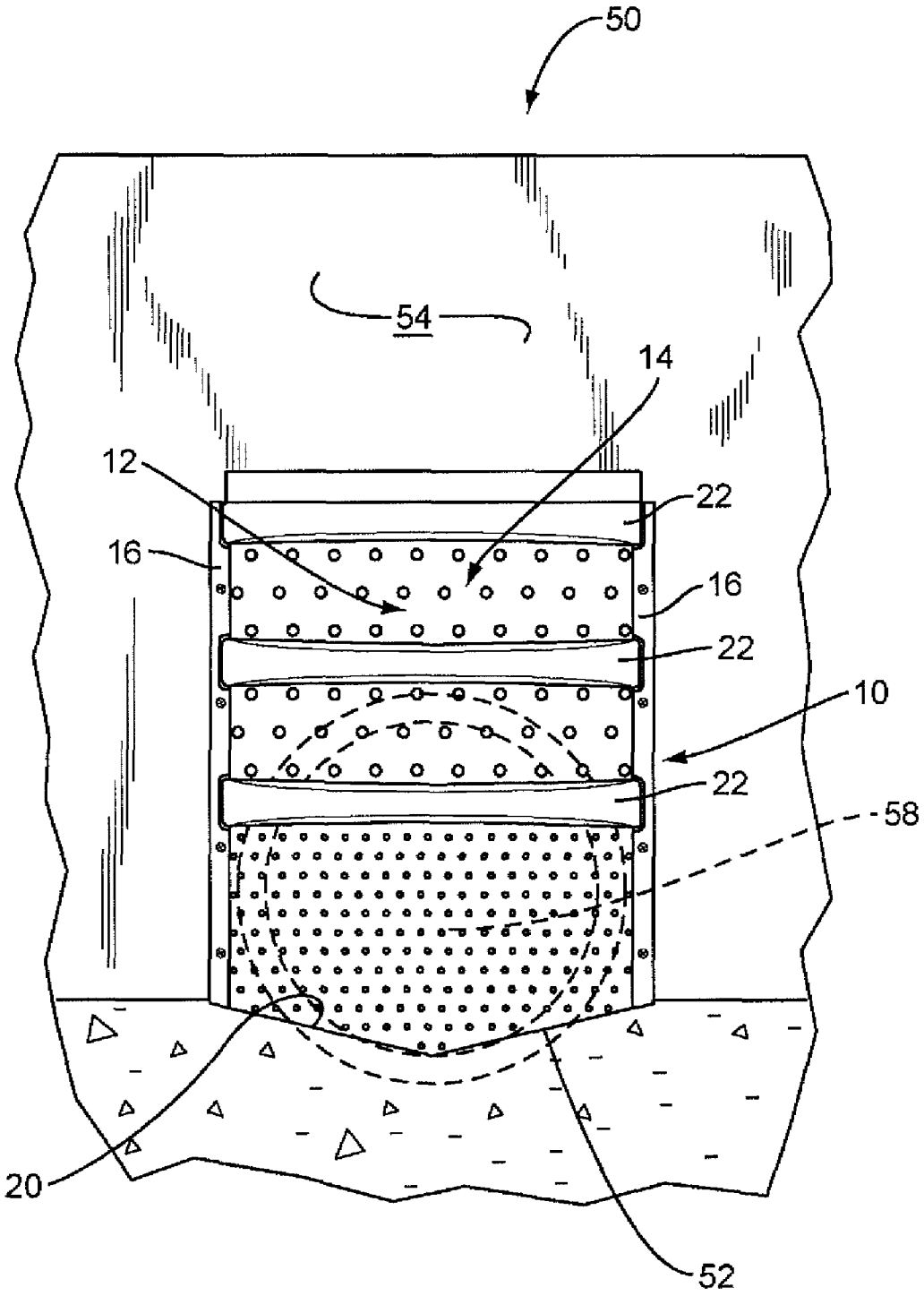
FIG. 4 is a fragmentary cross sectional view of a storm drain showing the filter of the present invention installed therein.
Figure 5:
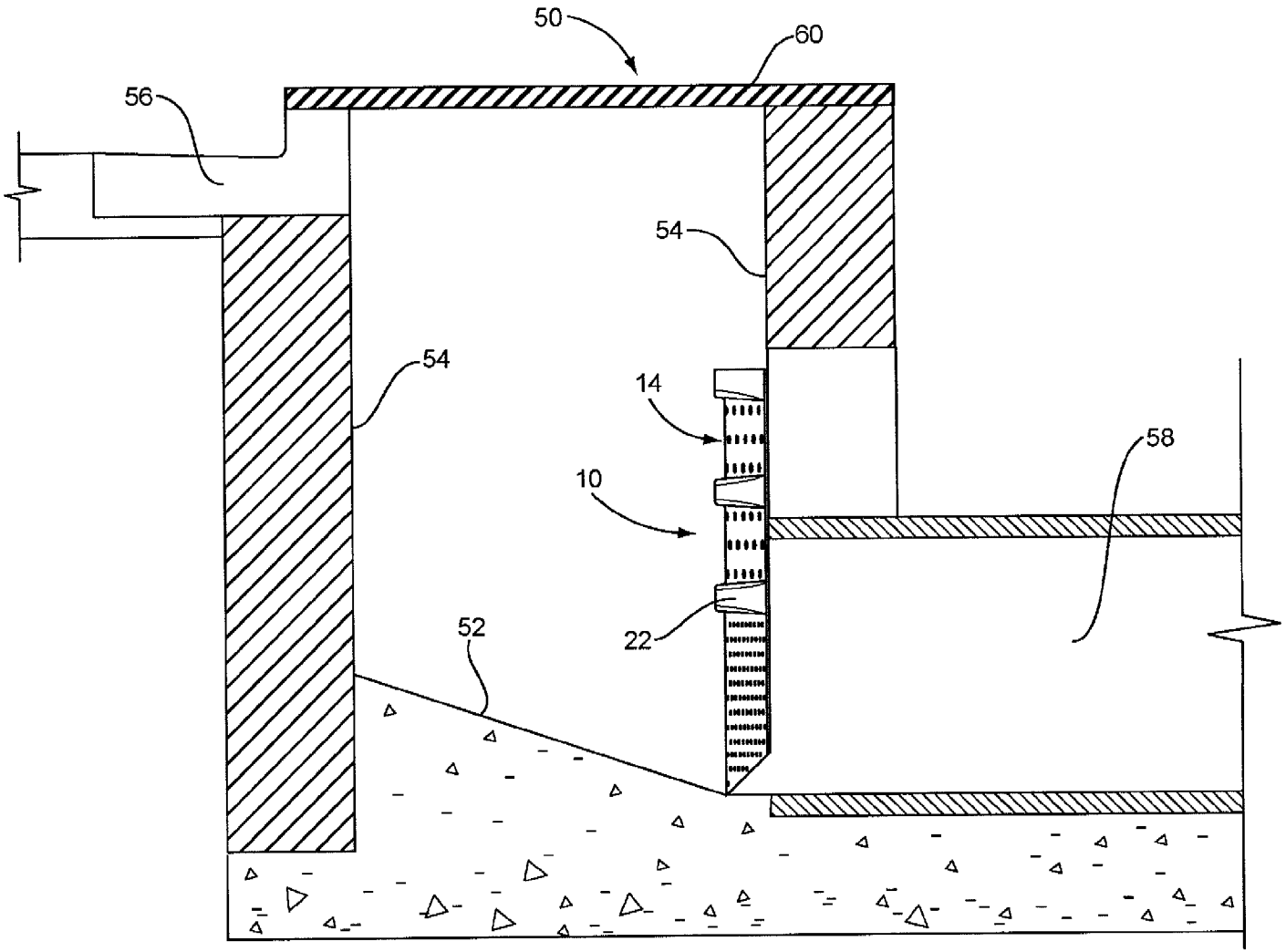
FIG. 5 is another cross sectional view of the storm drain showing the filter installed therein.

Viewing FIGS. 1-3, it is seen that the filter 10 assumes a generally curved or C-shape. Although filter 10, as shown in FIGS. 1-3, assumes a curved shape it should be appreciated that the basic shape could vary and could include various configurations such as a generally square C-shape. In any event, filter 10 is designed to be secured to a side wall 54 of the storm drain 50. As seen in FIGS. 4 and 5, the filter 10 projects outwardly from the side wall 54 and generally encompasses an area around an inlet 56 formed in the side wall.

Filter 10 can be said to include a back portion or area 12 and a pair of opposed side portions 14. In the case of the embodiment shown in FIGS. 1-3, the back portion 12 and the side portions 14 form a continuous or integral construction due to the generally curved or C-shaped nature of the filter 10. However, it is appreciated, for example, that the back portion 12 and the side portions 14 could be disposed at an angle, such as a 90° angle, to each other. In any event, the filter 10 includes an open side that is designed to fit adjacent or directly to the side wall 54 of the storm drain 50.

Disposed on each side of the filter 10 is a pair of flanges 16. In the case of the present embodiment, flanges 16 are generally flat and include an outwardly facing flat surface that abuts against the storm drain side wall 54 when the filter 10 is installed therein. To secure the filter 10 within the storm drain 50 there is provided a series of openings in each of the flanges 16. Fasteners such as bolts or screws can be inserted through the openings into the adjacent side wall 54 of the storm drain 50.

Filter 10 includes a series of transversely extending ribs 22. Ribs 22 extend between opposed flanges 16. In the case of the embodiment illustrated in FIGS. 1-3, there is provided three spaced apart ribs 22. However, it is appreciated that the number of ribs 22 can vary and that the filter 10 can be constructed without the incorporation of ribs.

Filter 10 includes a top 18 and a bottom 20. In the case of the particular design illustrated herein, the upper edge of the upper rib 22 forms the top edge 18. Bottom 20 in many embodiments will assume a non-linear configuration. This is because the bottom of storm drains will not be perfectly flat, especially in the area adjacent the outlet. This is because the bottoms of many storm drains are particularly configured to facilitate drainage towards the outlet. Thus, similar to that illustrated in FIGS. 4 and 5, the bottom of the storm drain can assume a V or trough shape adjacent the outlet 58. Accordingly, the bottom 20 of the filter 10 is normally formed or configured to conform to the bottom of the storm drain in the area where the filter 10 is to be positioned. That is, the bottom 20 of the filter 10 is designed to set flush against the bottom of the storm drain adjacent the site of the outlet.

In order to permit water to pass through the filter 10, as shown in FIGS. 1-3, the filter 10 is provided with a multiplicity of openings. In the case of the design illustrated herein, there is provided two sets of openings, a first set indicated generally by the numeral 24 and the second set indicated generally by the numeral 26. The first set of openings 24 is disposed about a lower portion of the filter 10 while the second set of openings 26 is disposed about an upper portion of the filter 10. The size of the openings of the first set 24 is smaller than the size of the openings comprising the second set 26 and disposed about the upper portion of the filter 10. Although the size, spacing and general arrangement of these openings can vary, this design for the openings will prevent smaller objects from passing through the filter 10 about the lower portion of the filter.

Turning particularly to FIGS. 4 and 5, there is shown therein a storm drain indicated generally by the numeral 50. Storm drain 50 includes a bottom 52 and a top 60. Extending upwardly from the bottom 52 around the storm drain 50 is a side wall 54. About an upper portion of the storm drain 50 there is formed an inlet 56. Additionally, about a lower portion of the storm drain 50 there is an outlet 58. The outlet 58 can assume various forms. In one embodiment, the outlet 58 would include a pipe that extends from one area of the side wall 54. In conventional fashion, outlet 58 channels or directs water from the storm drain 50 downstream therefrom.

As shown in FIGS. 4 and 5, filter 10 is disposed closely adjacent the side wall 54 in the area of the outlet 58. That is, the flanges 16 are disposed flush against the side wall 54 and a series of fasteners extend through openings in the flanges and into the side wall 54 to secure the filter 10 in place. Note in FIG. 4 that the bottom 52 of the storm drain 50 assumes a generally trough or V-shape adjacent the outlet 58. This, of course, facilitates the movement of water from the storm drain 50 into the outlet 58. In any event, the bottom edge 20 of the filter 10 is particularly cut or formed to conform to the shape of the bottom 52 in this area. Hence, the filter 10 can fit flush against the bottom.

The open face of the filter 10 generally lies in the plane of the flanges 16 and the flanges are generally coplanar. Thus, the back portion 12 of the filter is disposed relatively close to the side wall 54 of the storm drain. Essentially there is a space defined between the side wall 54 and the filter 10. Thus, it is appreciated that trash, debris and other undesirable objects are filtered by the filter 10 prior to these unwanted objects and materials entering the outlet 58. Thus, over a period of time, trash, debris and other unwanted objects will accumulate exteriorly of the filter 10. Therefore, from time to time it may be appropriate for the storm drain 50 to be cleaned. The filter 10, when installed in this manner, will prevent trash, debris and other unwanted objects and materials from passing through the storm drain 50 into the outlet 58.

Another embodiment for the storm drain filter is shown in FIGS. 6-9. In this embodiment filter 10 comprises a main filter section 30 and a pair of variable width grates 40. Each variable width grate 40 is adapted to connect to and extend from opposite ends of the main filter section 30. As will be appreciated from subsequent portions of this disclosure, the width of each variable grate 40 can be varied and this effectively enables the flow capacity of the filter 10 to be varied. When filter 10 is deployed in a storm drain, each of the variable width grates 40 span an area or gap 41 that exists between the main filter section 30 and the side wall 54 of the storm drain. Openings 42 provided in the variable width grate 40 permit storm water to flow through the grate. Openings 42, formed in each of the grates 40, are sized to substantially prevent movement of debris through the grate.

Main filter section 30 includes a sloped top 32 capping an upper portion of the main filter section. Top 32 prevents overflow of storm water and/or debris into the outlet 58 of the drain without passing through main filter section 30. Top 32 is generally sloped downward from the back to the front portion. A third set of openings or voids 28 is included in an upper portion of main filter section 30 immediately adjacent top 32 and above openings 26. Openings 28 are substantially larger than openings 26 and may be provided to allow limited overflow to accommodate surge conditions. Additionally, openings 28 provide access to the area between filter 10 and outlet 58 for inspection and cleaning while the filter is installed in storm drain 50.

In one embodiment, each variable width grate 40 comprises a series of spaced apart rods 44 and a support or mounting strip 48. The mounting strip 48 includes a series of spaced apart openings for receiving an end portion of the rods 44. Main filter section 30 includes a pair of end or side flanges 16. Each flange 16 includes a series of rod openings for receiving the opposite ends of the rods 44. Thus, as seen in the drawings, when the filter 10 is installed in a storm drain, the rods 44 are supported in the supports or strips 48 on one end, and supported on the other end by the rod openings in flange 16 of the main filter section 30. The rods may be formed of various materials amenable to use in storm water drains. In one embodiment the rods 44 are formed of a polymeric material such as, for example, nylon rods.

To position main filter section 30 at a selected distance D from side wall 54, retainers connect between rods 44 and flanges 16. In one embodiment the retainers comprise locking collars 46 disposed on rods 44 and abutting flanges 16. Each locking collar 46 is adapted to snugly fit onto rod 44 to resist being moved along the length of the rod. In one embodiment, locking collars 46 comprise steel washers 46A having a compliant washer 46B bonded thereto. See FIG. 8. Steel washer 46A may be flat or bowled. Compliant washer 46B is sized to provide an interference or friction fit on rod 44.

At least one locking collar 46 is disposed on each rod 44 between one flange 16 and support 48, thereby defining a gap 41 between main filter section 30 and side wall 54. Similarly disposing a locking collar 46 on each of the rods 44 extending from supports 48 provides a stable mounting plane to align main filter section 30 at a selected distance from side wall 54. These locking collars 46 are referred to as inner locking collars. Main filter section 30 is positioned such that rods 44 extend through aligned openings in flanges 16 and the flanges abut the inner locking collars 46. Additional locking collars 46 may be placed over the ends of the rods 44 to further stabilize the filter section 30 in the selected position. These latter locking collars 46 are referred to as outer locking collars To more firmly secure main filter section 30 in place, one or more fasteners may be used to prevent the main filter section from backing off the side wall 54 beyond the selected distance D in events where the locking capacity of locking collars 46 is exceeded. In one embodiment, the fasteners comprise threaded bolts 49. Threaded bolts 49 extend through openings in the supports 48 and are threaded into threaded inserts 49A embedded in the concrete side wall 54. Thus engaged, bolts 49 secure the main filter section 30 and prevent movement of the main filter section farther away from side wall 54.

Figure 7:
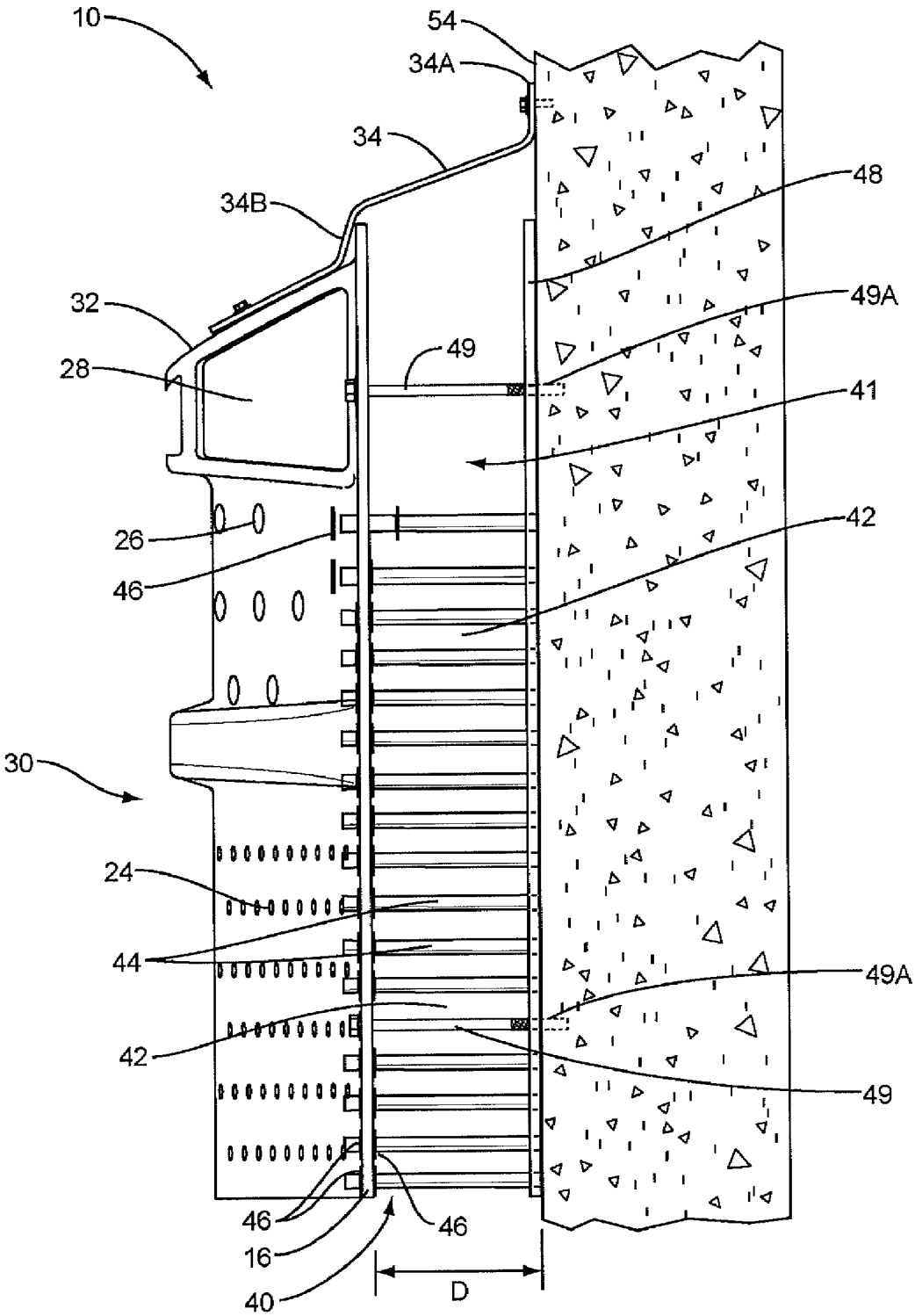
FIG. 7 is a side elevation view of the filter of FIG. 4 installed in a storm drain.
Figure 8:
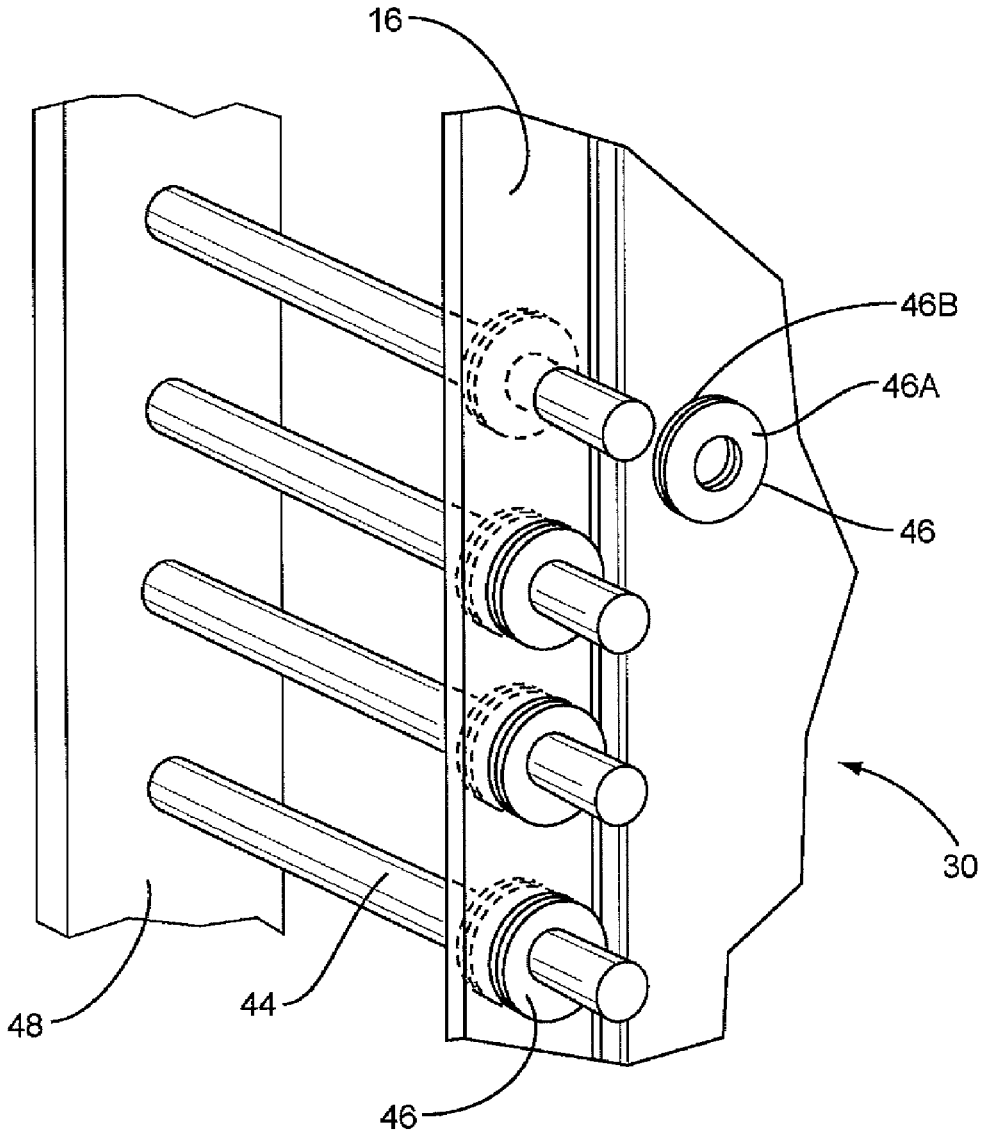
FIG. 8 is a fragmentary perspective view of the variable width grate.

As can be appreciated from FIG. 7, when installed variable width grates 40 include grated side openings comprised of rods 44 and openings 42 through which storm water flows. In the illustrated embodiment spaced rods 44 from a grill or grated arrangement that substantially prevents debris from reaching the outlet 58 and provides additional flow capacity to filter 10.

As mentioned above, main filter section 30 includes a slope top 32. In some cases, when installed in a storm drain, inflowing water and debris will impact the top portion of the filter 10. In these cases, the slope top 32 tends to deflect the water and debris away from the outlet 58.

Figure 9:
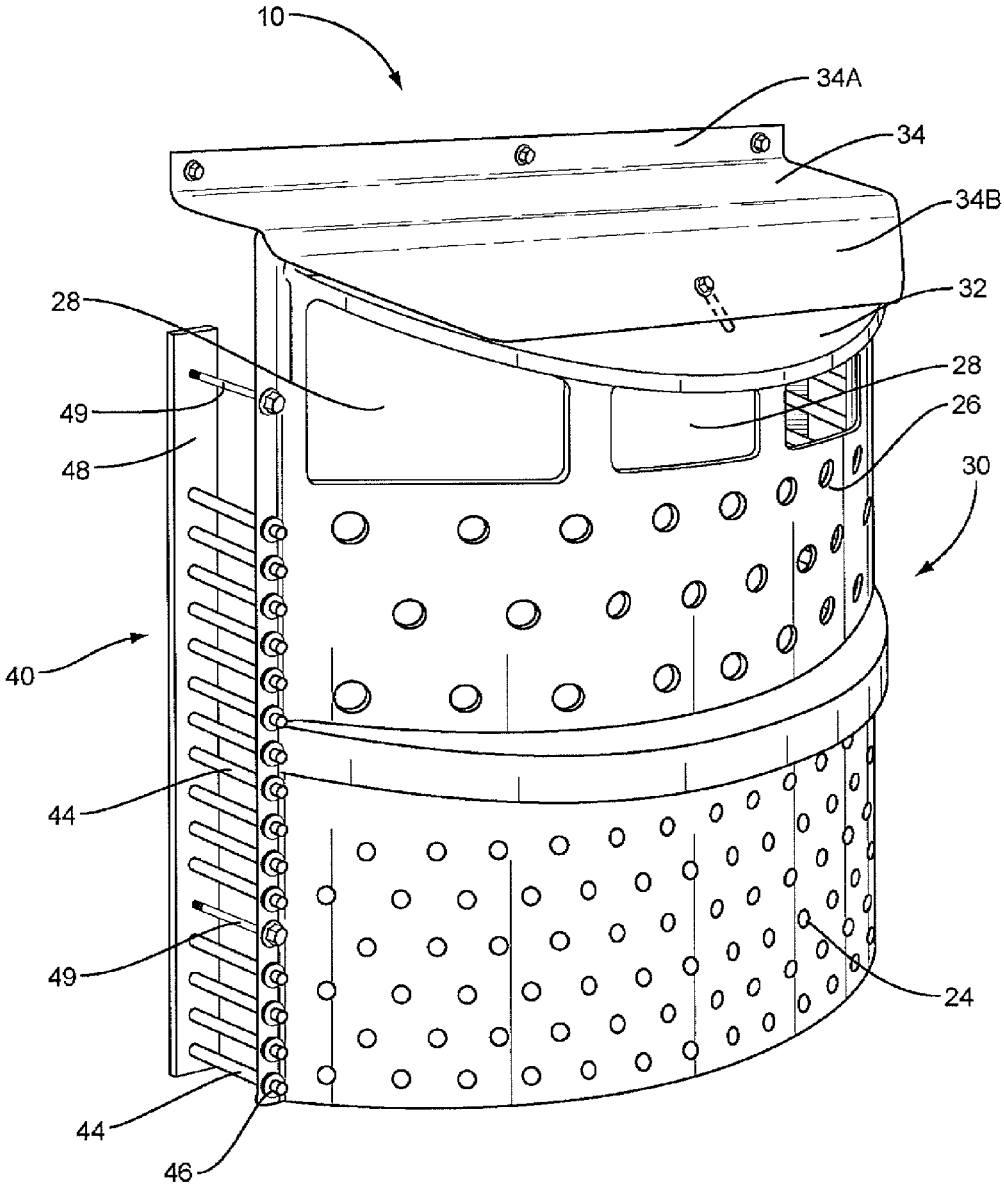
FIG. 9 is a perspective view of an installed filter including the variable width grate and a top flashing.
Figure 10:
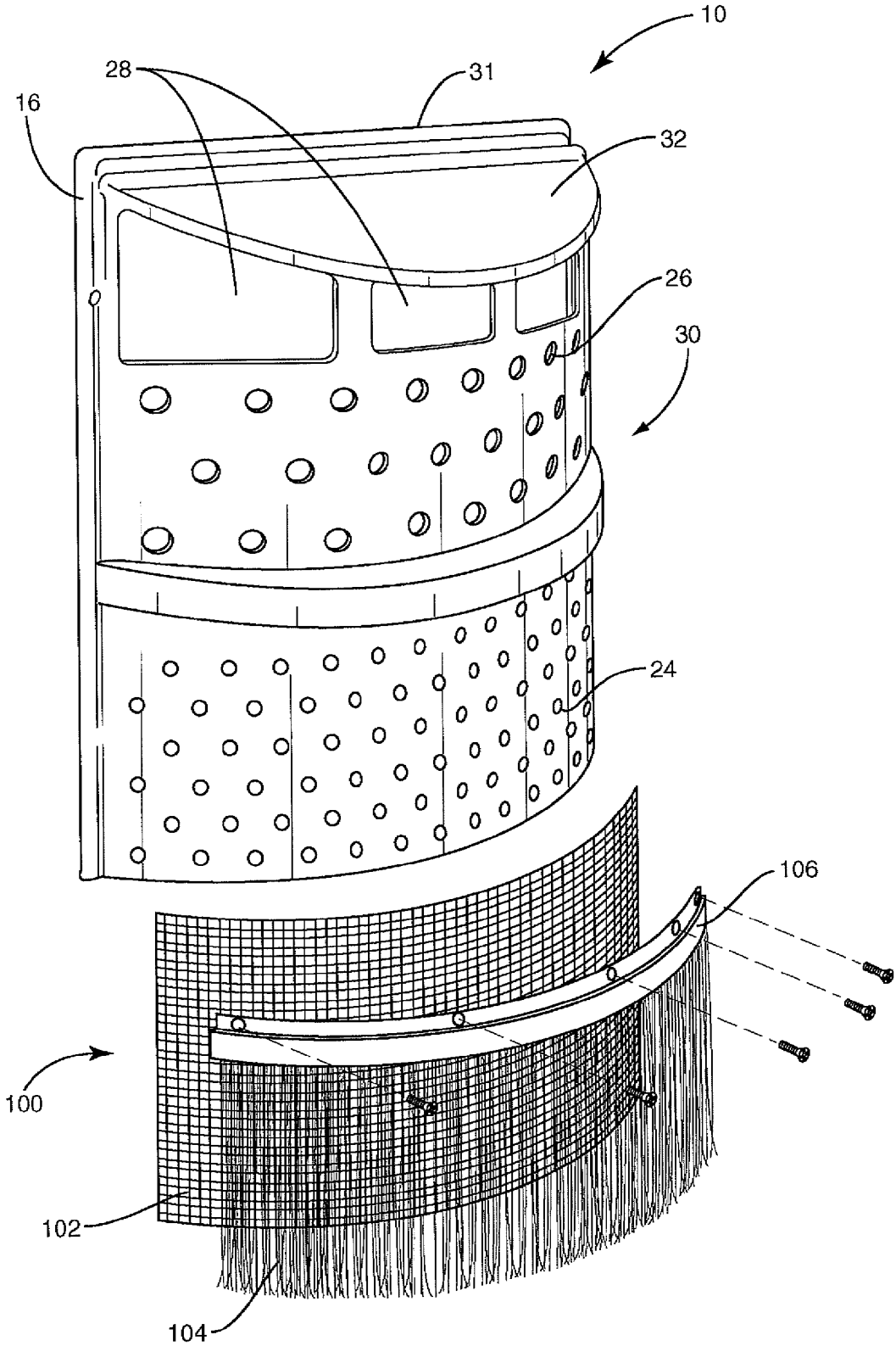
FIG. 10 is a perspective view of another embodiment of the present invention showing a flexible filtering assembly adapted to be secured to the bottom portion of the panel that forms the filter.
Figure 11:
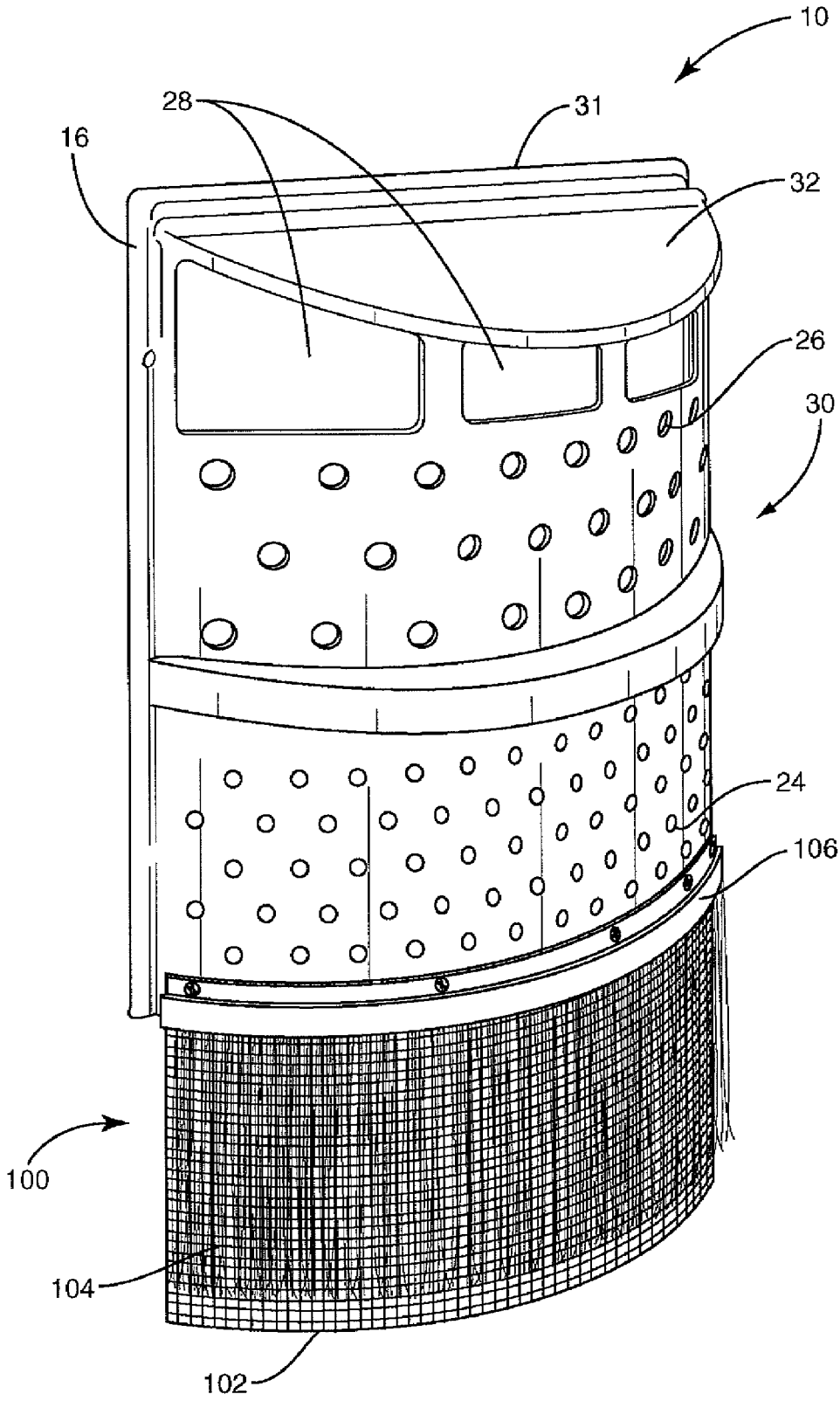
FIG. 11 is a perspective view similar to FIG. 10, but showing the flexible filtering assembly attached to the panel.
Figure 12:
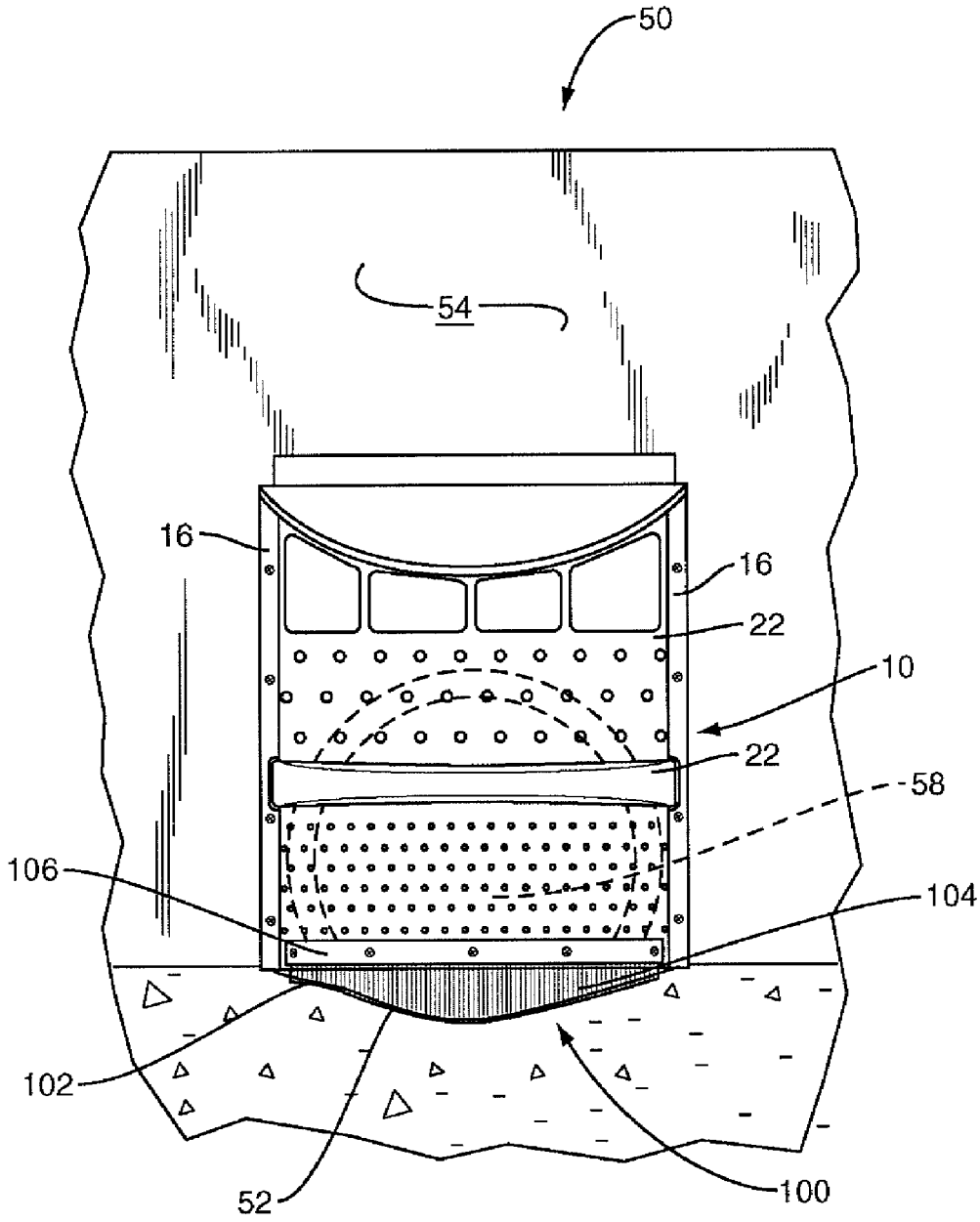
FIG. 12 is an elevation view showing the filter of FIG. 10 secured to the sidewall of the storm drain.
Figure 13:
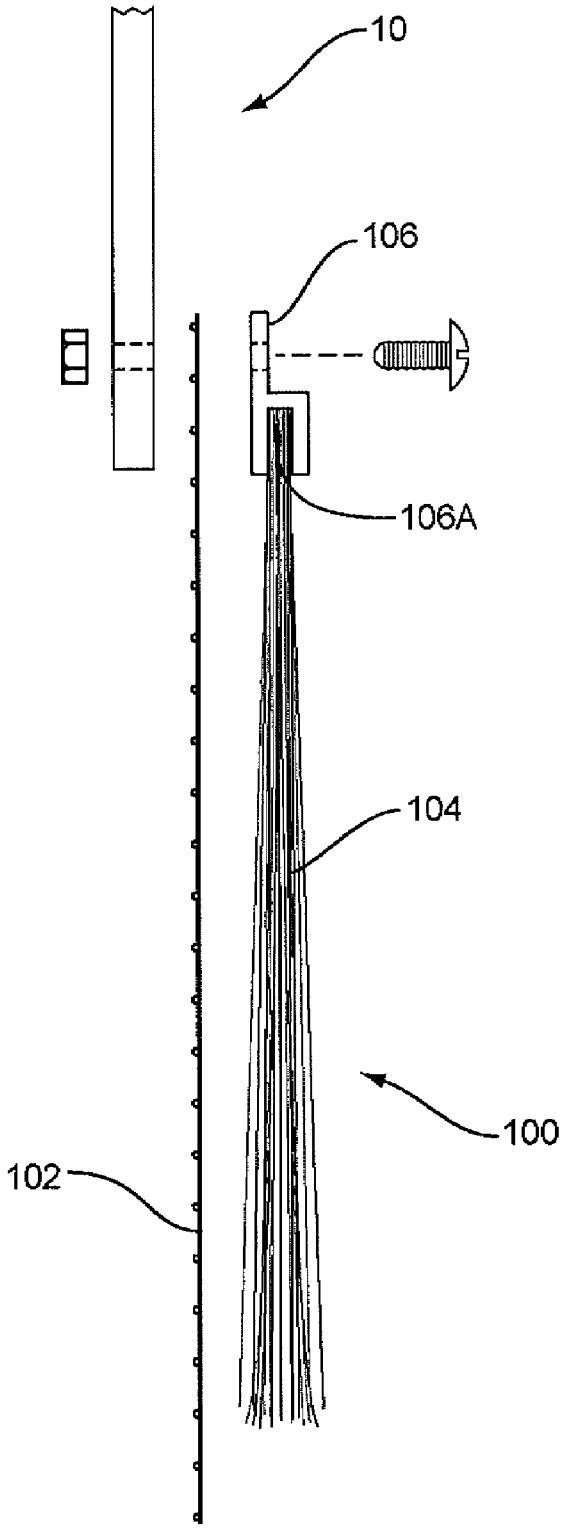
FIG. 13 is a fragmentary sectional view that is exploded to better illustrate the components of the flexible filtering assembly.
Figure 14:
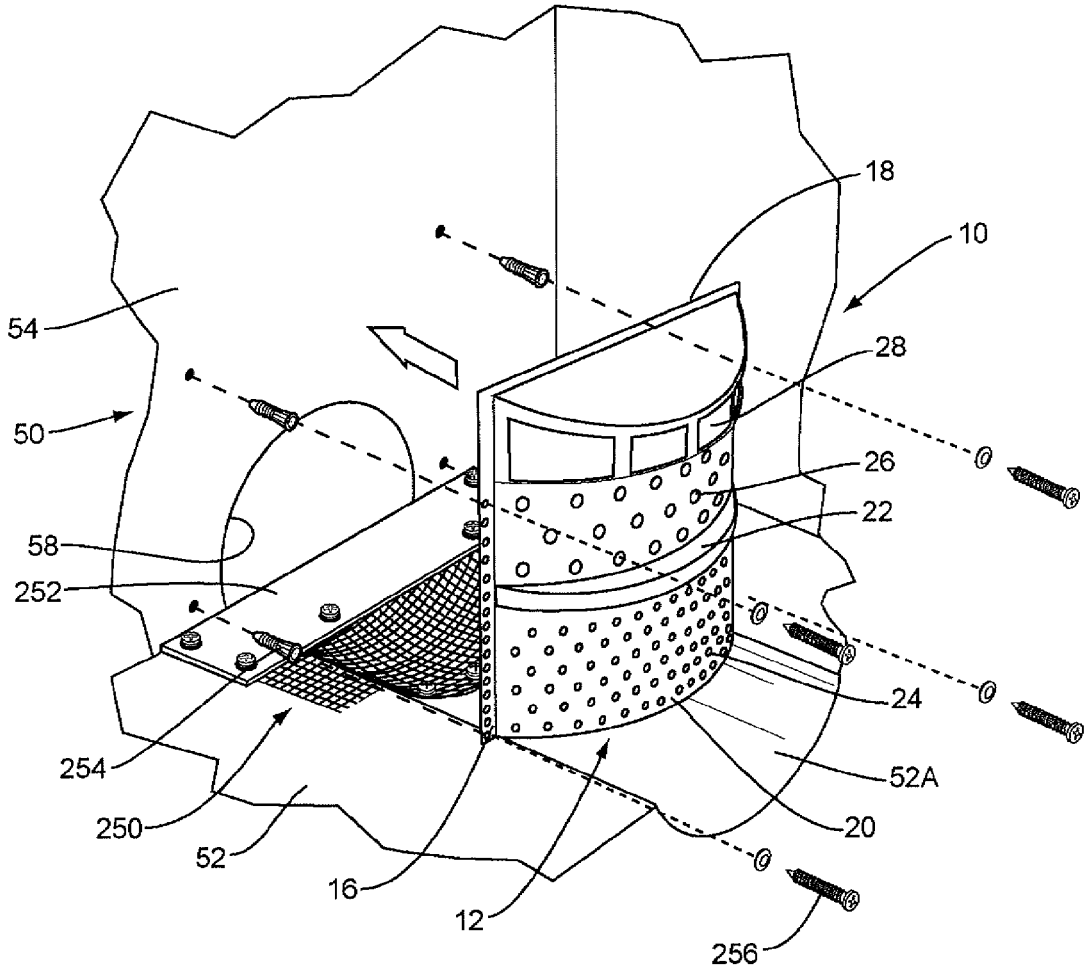
FIG. 14 is a perspective view showing an alternate design for the storm drain filter.
Figure 15:
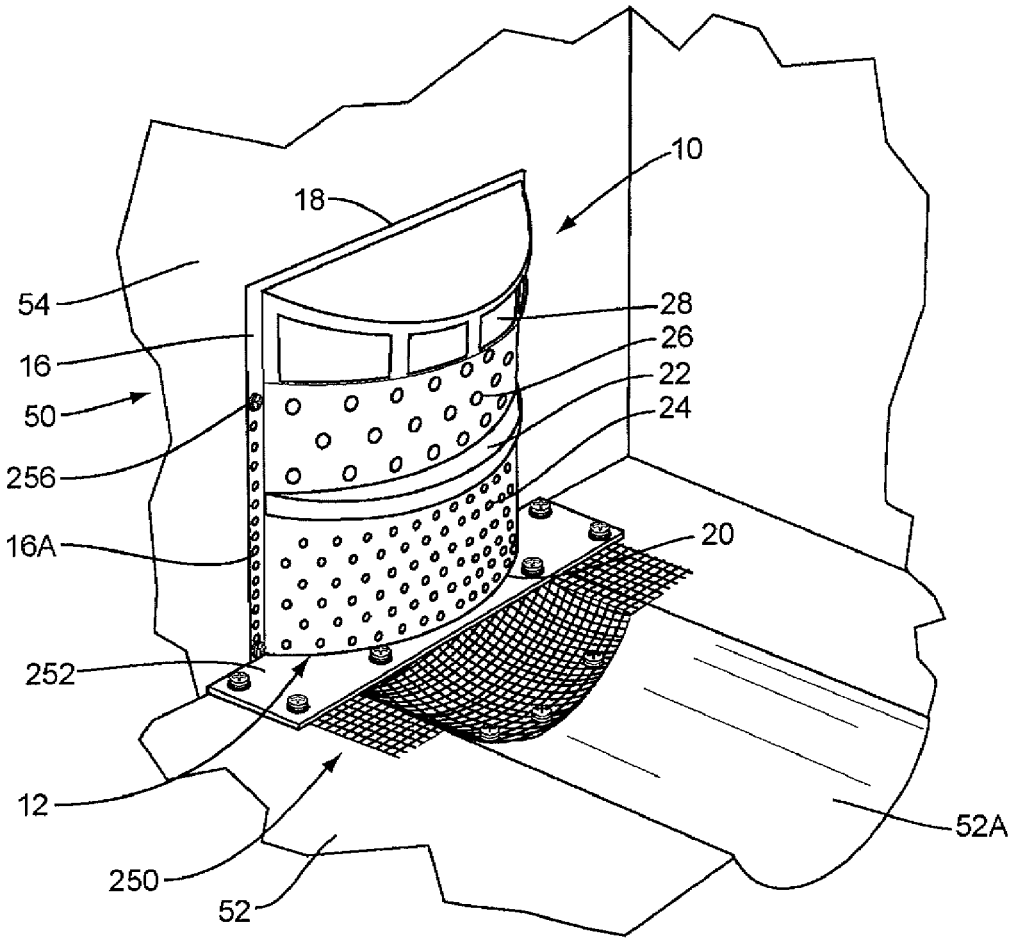
FIG. 15 is a perspective view showing the filter shown in FIG. 14 secured to the sidewall of the storm drain.
Figure 16:
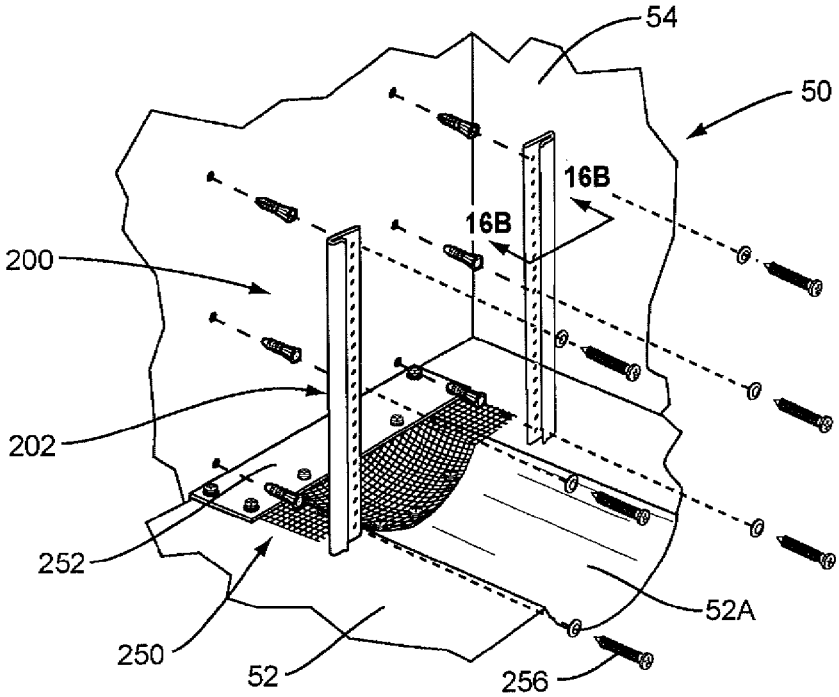
FIG. 16 is a perspective view showing a mounting assembly for mounting the main section of filter to the sidewalls of a storm drain.
Figure 16A:
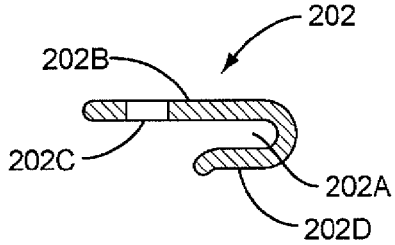
Figure 17:
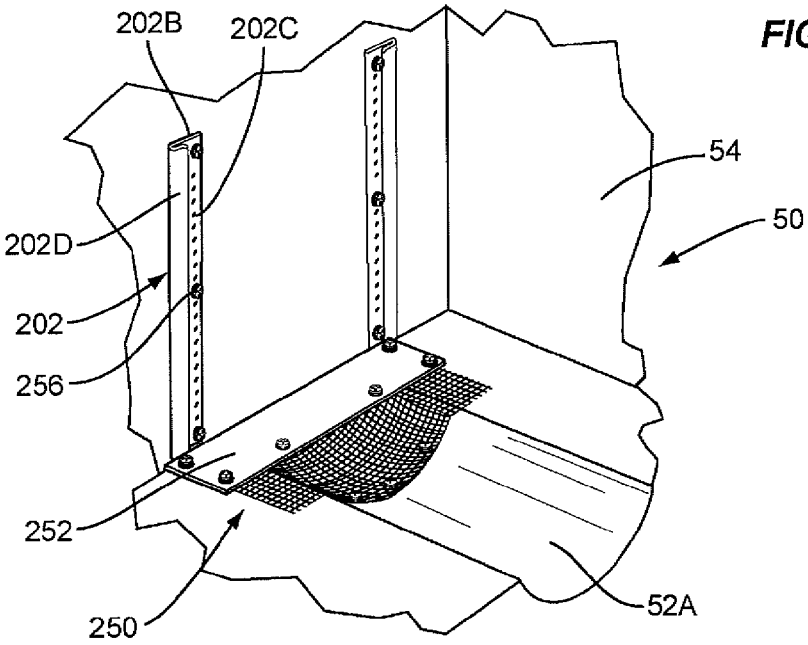
FIG. 17 is a view similar to FIG. 16 but showing the mounting brackets actually attached to the sidewall of the storm drain.
Figure 18:
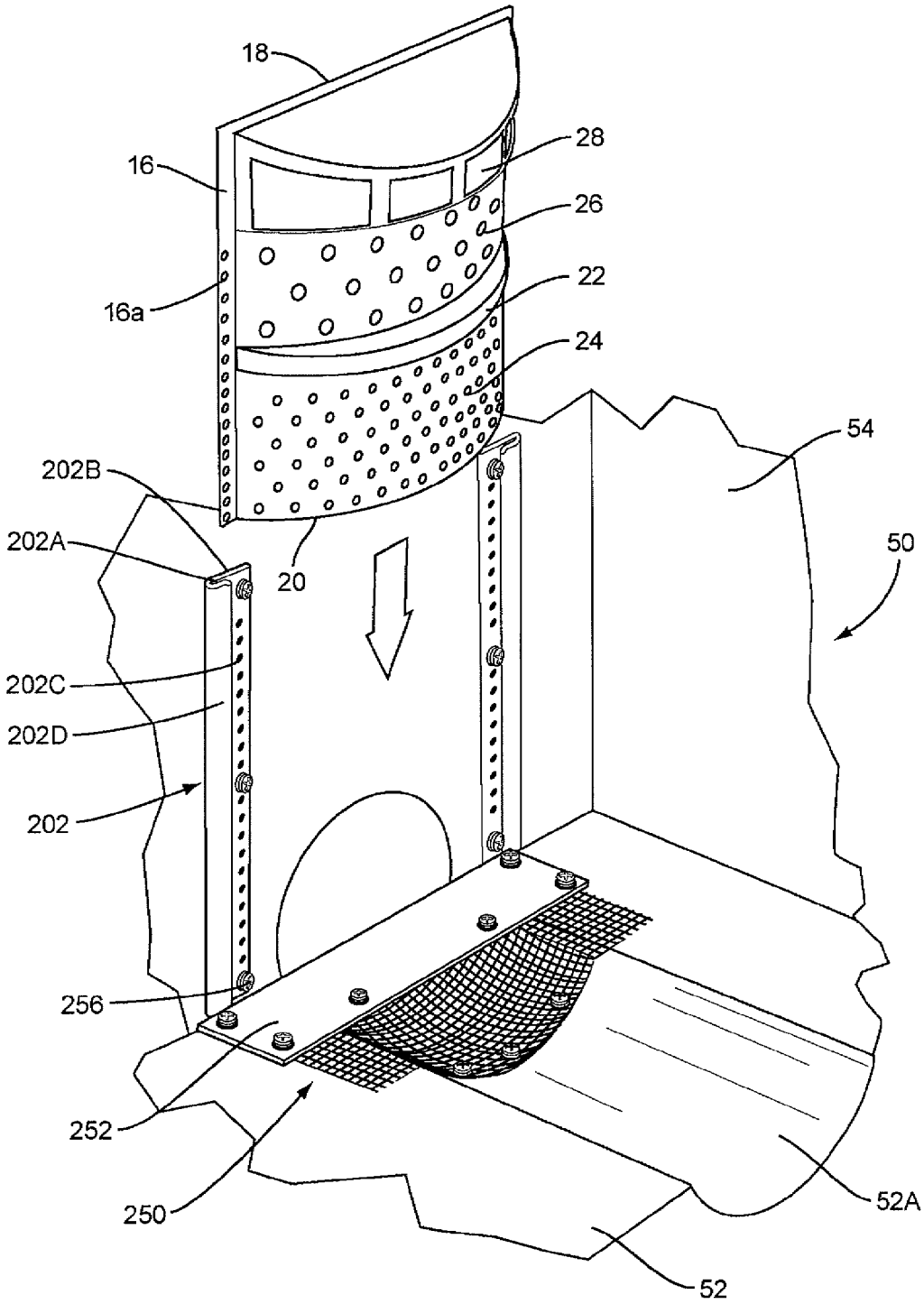
FIG. 18 illustrates how the filter is attached to the sidewalls of the storm drain via the mounting brackets.
Figure 19:
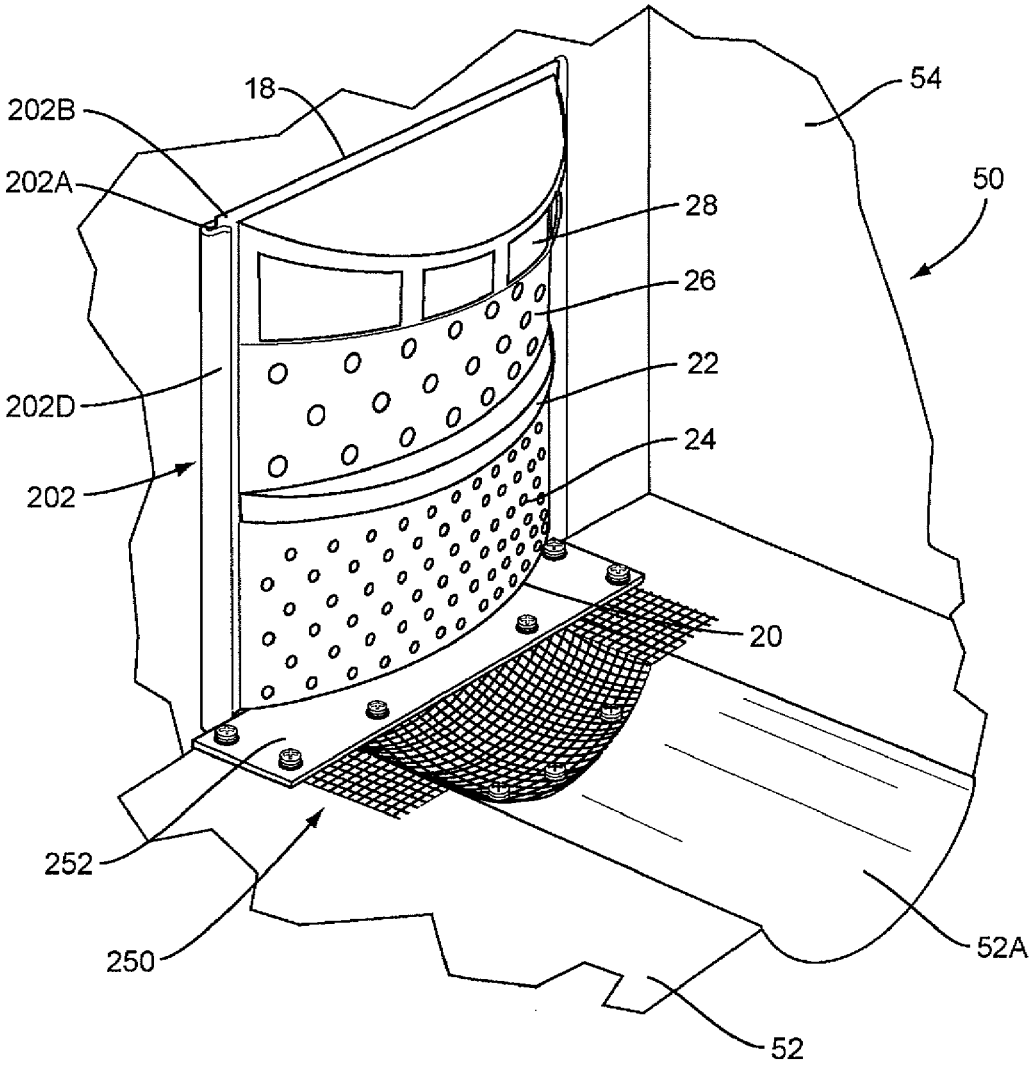
FIG. 19 shows the filter attached to the sidewall of the storm drain via the mounting brackets.
Figure 20:
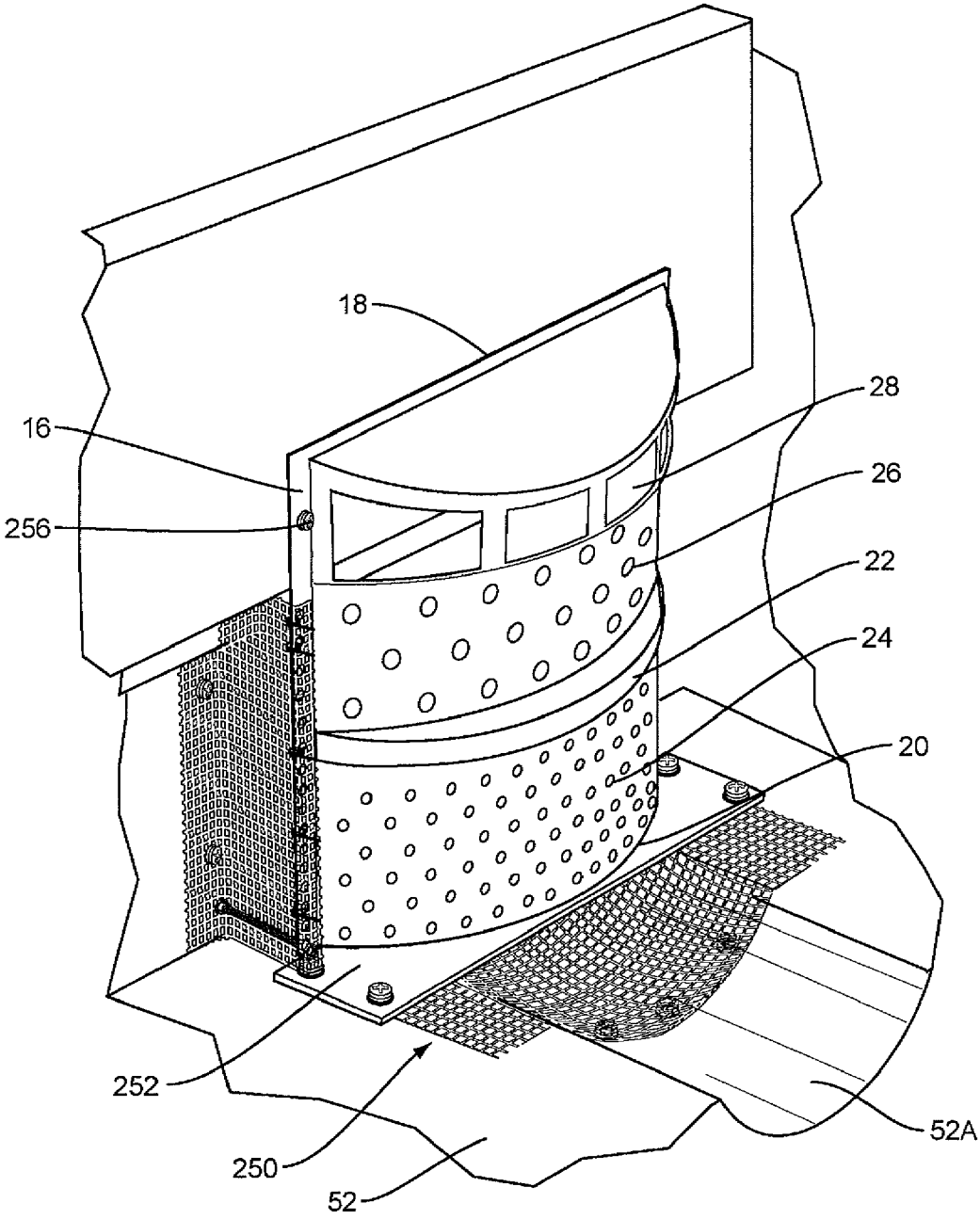
FIG. 20 is a perspective view showing an installed filter system with flexible mesh disposed underneath the main section of the filter as well as adjacent the sides of the filter.

Furthermore, in some cases, the main filter section 30 will be used with one or both of the variable grates 40. When the main filter section 30 is used with one or both variable grates 40, the main filter section 30 will generally be spaced outwardly from the side wall 54. See FIG. 7. To close the top of the filter 10, there is provided a flashing 34. Flashing 34 is secured to the side wall 54 and overlaps a portion of the slope top 32, as illustrated in FIGS. 7 and 9. In one embodiment, flashing 34 comprises a bent metal sheet having a wall mount portion 34A angled relative to an overlapping portion 34B. Wall mount portion 34A of the flashing 34 may be secured to the side wall 54 by various conventional means, such as masonry screws for example. Overlapping portion 34B extends over at least a portion of the slope top 32 and can be secured thereto with a bolt or other type of fastener. In one embodiment the overlapping portion 34B slidably contacts the slop top 32 such that the flashing 34 is permitted to slide against the slope top of the main filter section 30.

Figure 6:
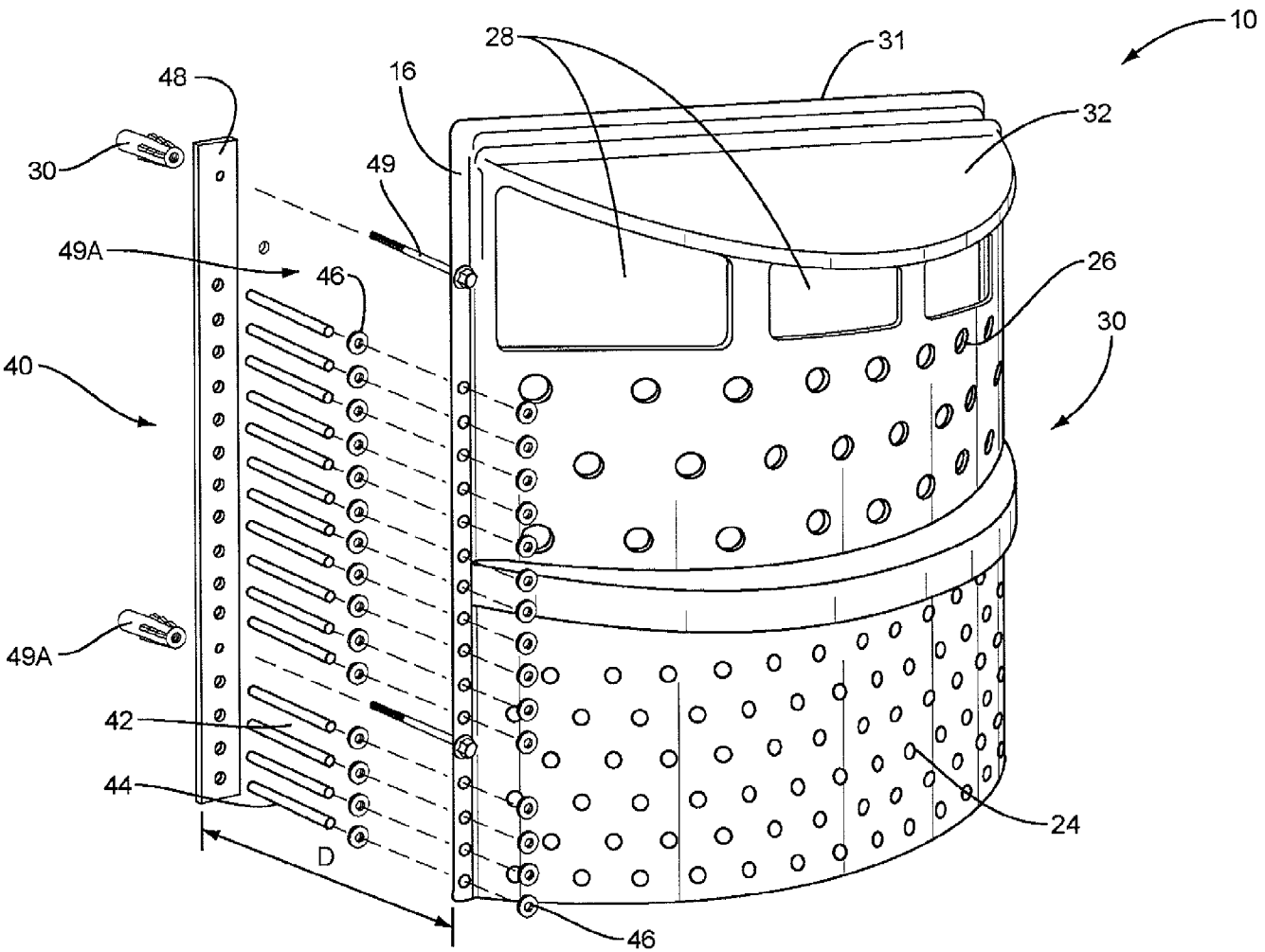
FIG. 6 is an exploded perspective view of an alternative design for the filter and shows a main filter section and a pair of variable width grates extending from the main filter section.

From the foregoing it is appreciated that the filter 10 can be configured to yield various flow capacities. For example, the filter 10 can be configured for a particular flow capacity by utilizing the two variable width grates 40. Each variable width grate 40 is effectively coupled to a flange 16 of the main filter section 30. Thus, the entire filter 10 comprises the main filter section 30 and the pair of variable width grates 40. The flow capacity of the filter 10 can be more particularly varied by adjusting the rods 44 with respect to a respective flange 16. That is, the main filter section 10 can be positioned at various distances with respect to the support 48. This effectively varies D, as illustrated in FIG. 6.

As discussed above, the individual rods 44 are supported at one end by openings in the support 48 and at the other end by openings formed in the respective flange 16 of the main filter section. Each rod 44 can be generally fixed with respect to the flange 16 by positioning opposing collars 46 as illustrated in FIG. 7. The inner collars 46 tend to prevent the rods 44 from being dislodged from the openings in the supports 48. The outer collars 46, on the other hand, cooperate with the inner collars to station the rods 44 with respect to the flange 16. Again, to secure the main filter section 30 in place, the elongated bolts 49 prevent the main filter section 30 from moving right to left, from the side wall 54, as viewed in FIG. 7.

To adjust the flow capacity of filter 10 after installation, main filter section 30 may be moved inwards or outwards by applying forces sufficient to overcome the friction of locking collars 46 to reposition the main filter section 30 to a different spacing D from side wall 54. Locking collars 46 are then re-snugged against flanges 16. It may be required to loosen or tighten bolts 49 or to replace the bolts with bolts of a different length, depending on the amount of the adjustment.

Another embodiment of the present invention is shown in FIGS. 10-13. In this embodiment, the storm drain filter is provided with a flexible filtering assembly that is indicated generally by the number 100. The storm drain filter 10 of this embodiment is substantially similar to the storm drain filter discussed above and shown in FIGS. 1-5. In the embodiment shown in FIGS. 1-5, the lower edge of the filter panel is cut to conform to the uneven bottom 52 of the storm drain 50. In this embodiment however, the flexible filtering assembly 100 which is attached to the bottom portion of the panel of the filter 10 is deformable or flexible so as to conform to the shape of the bottom 52. Thus in this embodiment, the actual lower edge of the filter is not cut during the installation process.

With reference to FIGS. 10-13, the flexible filtering assembly 100 includes a flexible perforated backing 102 that projects downwardly from the bottom portion of the panel that forms the filter 10. Flexible perforated backing 102 extends substantially the entire width of the filter 10. Backing 102 can be constructed of various materials but it is contemplated in one embodiment that the perforated backing would be constructed of a plastic material. Backing 102 is flexible, bendable and can generally conform to the shape of the bottom 52 of the storm drain 50. In the embodiment illustrated herein, the flexible perforated backing 102 assumes a perforated plastic mat. The openings or perforations in the mat are square or rectangular and the mat forms a generally open grid.

Disposed adjacent the flexible perforated backing 102 is a multiplicity of bristles 104. Bristles 104 project downwardly from the bottom portion of the panel that forms the filter 10 and the bristles lie adjacent the flexible perforated backing 102. Each of the bristles is elongated but yet flexible and bendable. Bristles of various types can be used but it is contemplated that synthetic bristles may be desirable because of their ability to withstand abrasion and because of their general long life. Bristles 104 are densely packed and in combination with the flexible perforated backing 102 will filter debris and trash and the bristles 104 will also effectively filter silt and fines. Together the flexible perforated backing 102 and the multiplicity of bristles 104 will prevent trash, debris, silt and fines from entering the outlet of the storm drain.

As illustrated in the drawings, the flexible perforated backing 102 assumes an inner position and the multiplicity of bristles 104 lie adjacent and on the outer side of the flexible backing 102.

In order to secure the flexible backing 102 and the bristles 104 to the panel of the filter 10, there is provided an elongated attaching or fastening strip 106. In one embodiment, the fastening strip 106 is a hard rubber material that is at least slightly deformable or bendable such that it can be curved to conform to the general curve shape of the filter 10. Fastening strip 106 includes an elongated groove of 106A that extends substantially the length of the fastening strip. See FIG. 13. Upper portions of the bristles 104 are projected into groove 106A and are tightly secured therein. Various conventional means can be utilized to secure bristles 104 into the groove 106A. It is contemplated that in one embodiment, the upper portions of the bristles 104 will be glued into the groove 106.

Fastening strip 106 with the bristles 104 depending therefrom is fastened or secured to the filter 10 about a lower edge or lower portion thereof by a series of bolt assemblies. In order to secure the flexible perforated backing 102 to the filter 10, an upper edge portion of the backing 102 is sandwiched between the fastening strip 106 and panel of the Filter 10. Thus, both the flexible perforated backing 102 and the bristles 104 are effectively secured to the panel by the fastening strip 104.

The length or height of the backing 102 and bristles 104 can vary. The length of the backing 102 and the bristles 104 should be sufficient that when the filter 10 is properly placed in the storm drain 50 that both the flexible backing 102 and the bristles 104 will extend down and meet the bottom 52 of the storm drain at which point both will curve and bend outwardly such that a portion of the flexible backing 102 and the bristles 104 will lie adjacent the bottom 52 of the storm drain 50. See FIG. 12 for example. Thus, the flexible backing 102 and the bristles 104 form a part of the filter 10 and more particularly form a part of the lower portion thereof. Further, the flexible backing 102 and the bristles 104 are specifically designed to be flexible and deformable such that they will conform to the uneven bottom 52 of the storm drain. This eliminates the need to cut or particularly shape the lower edge of the panel that forms the main structure of the filter. In addition, the flexible backing 102 and the bristles 104 are efficient at filtering not only trash and debris but silt and fines.

In some cases, both the flexible backing 102 and the bristles 104 may not be required. In some cases either the flexible backing 102 or the bristles 104 may be sufficient to filter the necessary trash and debris entering the storm drain.

As discussed above, in some cases, the filter 10 may be spaced away from the wall of the storm drain. See, for example, the embodiment of FIG. 7. Another option for closing the side areas of the filter 10 is to also use the flexible backing 102 along the sides when the flanges 16 are spaced from the side wall of the storm drain. In other words, the flexible backing 102 can be used in lieu of the variable width grate illustrated in FIGS. 6 and 7.

Storm Drain Filter Including Flexible Mesh

With reference to FIGS. 14-21, another embodiment of the storm drain filter is shown therein. Here, filter 10 includes a main section or panel indicated generally by the number 12 and a flexible mesh that is associated with the main section or panel around selected or certain extremities of the main section. For example, and as described below, a flexible mesh can be utilized in conjunction with the main section or panel where there is a depression 52A in the bottom of the storm drain 50. More particularly as described below, the flexible mesh can extend from the bottom of the main section or panel into the depression 52A and will conform to the depression such that water passing through the depression and underneath the main section or panel 12 of the filter will be screened.

Turning to FIGS. 14-21, the filter is shown therein and indicated generally by the number 10. Filter 10, as described above in connection with the other embodiments disclosed herein, includes a main section or panel indicated generally by the numeral 12 that is of a molded plastic design. Extended along opposite edges of the main section 12 is a pair of flanges 16. Flanges 16 include a series of openings 16A that enable the flanges to be secured to the side wall 54 of the storm drain 50. Main section 12 includes a top 18 and a bottom 20. One or more ribs 22 are formed in the main section 12 to impart strength to the main section.

In order to permit water to flow through the main section 12, there is provided a series of openings in the wall of the main section. In the case of the embodiment illustrated in FIGS. 14-21, the main section 12 includes a first set of spaced apart openings 23. As seen in the drawings, the first set of openings 23 extends transversely underneath the top 18. There is also provided an intermediate set of openings with the intermediate openings being referred to by the numeral 24. About the lower portion of the main section 12 there is provided another set of openings referred to by the numeral 26.

In some cases, the bottom 52 of the storm drain 50 will be generally flat. Furthermore, the side wall 54 adjacent the outlet 58 in many cases is generally vertical. In such a case, the main section 12 can simply be bolted and secured directly to the side wall 54 of the storm drain 50. More particularly, concrete screws can be utilized to secure the flanges 16 to the side wall 54. Because the bottom 52 of the storm drain is generally flat, the bottom 20 of the main section 12 will generally rest flush against the bottom of the storm drain. In this case the main section or panel 12 standing alone is sufficient to screen or filter the water passing through the storm drain 50 into the outlet 58.

As shown in FIGS. 14-21, in some instances the bottom 52 of the storm drain is irregularly shaped. In some cases, to facilitate the flow of water along the bottom 52 and into the outlet 58 there is formed a depression 52A in the bottom near the outlet. As seen in the drawings, the depression 52A assumes the shape of a trough and effectively channels water from various areas in the storm drain into the outlet 58. In this case, it is difficult to make the bottom 20 of the main section 12 conform to the depression 52A. To deal with this problem, this embodiment uses a flexible filtering mesh. The mesh or grid is flexible and is generally constructed of a plastic or rubber material. Other types of perforated or mesh structure can be used. In a preferred embodiment, one characteristic of the mesh is that it can be bent, curved and shaped to conform to various surfaces.

In the drawings (FIGS. 14-21), a flexible mesh indicated generally by the number 250 is provided and forms a part of the filter 10 or the filter system disclosed herein. The flexible mesh 250 in some cases is disposed below the main section 12. In the embodiment illustrated herein, the flexible mesh 250 is secured to a plate 252. Plate 252 can be constructed of various materials such as plastic, rubber, etc. In this embodiment, the plate 252 having the flexible mesh 250 secured thereto is extended over the depression 52A in the bottom 52 of the storm drain 50. See FIG. 14. The flexible mesh 250 attached to the plate 252 is pressed down and caused to conform to the depression 52A. A series of concrete screws or bolts secure both the plate 252 and the flexible mesh 250 to the bottom 52 or depression 52A of the storm drain. Varying types of screws, bolts or other fasteners can be used to secure the plate 252 and flexible mesh 250 in position. In one embodiment there is provided a series of anchor inserts 254 and a series of screws/bolts 256. By utilizing a masonry drill, holes are drilled in the bottom 52 of the storm drain 50. The holes are particularly sized such that the anchor inserts 254 are frictionally held therein. Next, the screws/bolts 256 are inserted through the plate 252 and through portions of the flexible mesh 250 and into the anchor inserts 254 resulting in the plate and flexible mesh being securely anchored to the bottom 52 of the storm drain 50. Here the flexible mesh 250, before being attached, is pressed down into the depression so as to assure that the flexible mesh 250 is correctly positioned to screen all the water being channeled through the depression 52A to the outlet 58. In this embodiment the main section of panel 12 is positioned over the plate 252. Indeed in one embodiment the bottom 20 of the main section 12 fits flush against the plate 252 while the flanges 16 are secured directly to the side wall 54 of the storm drain 50 or are otherwise secured in such a manner that unscreened water cannot bypass the main section 12 of the filter 10.

Figure 21:
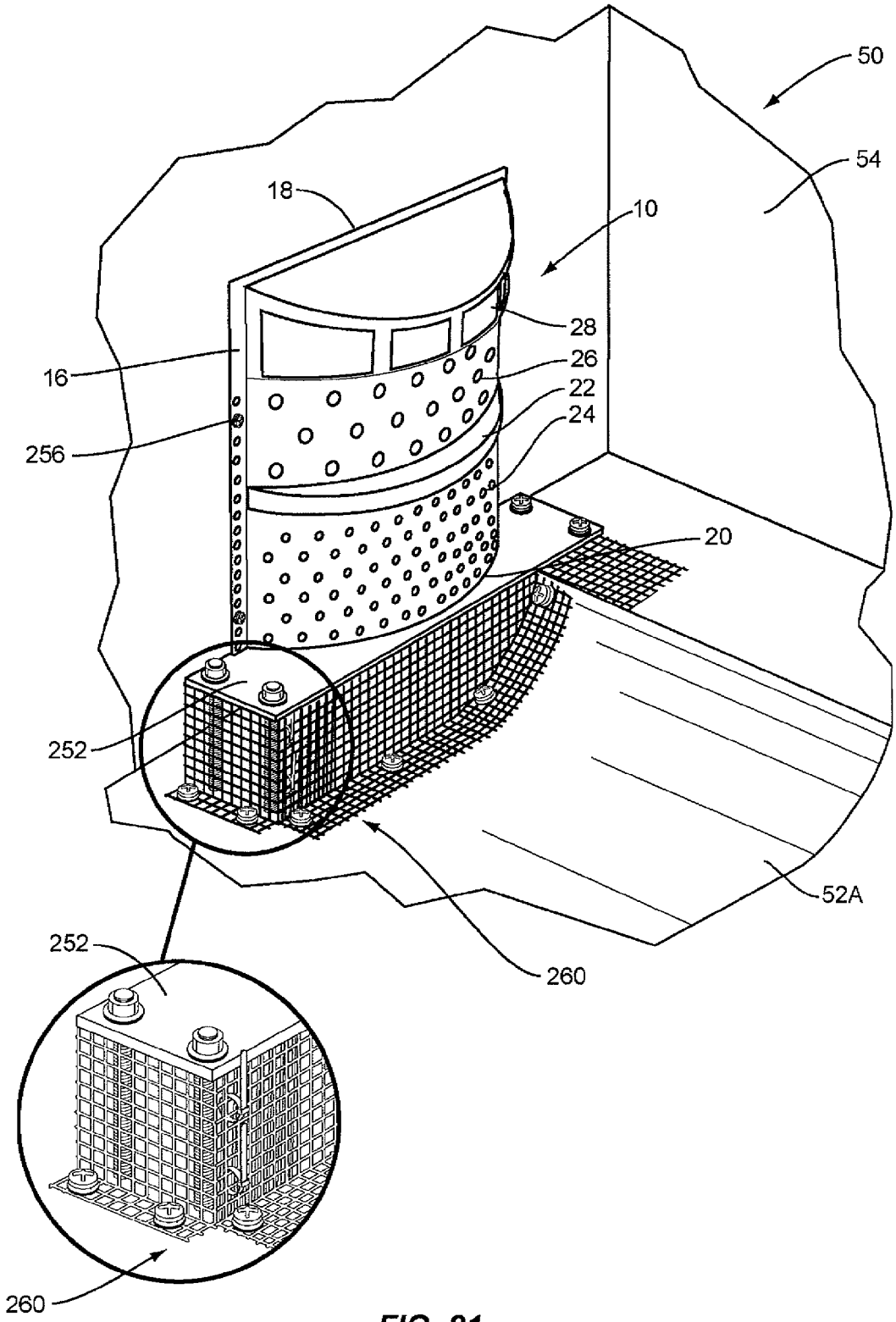
FIG. 21 is a perspective view of the filter used in conjunction with flexible mesh that extends downwardly from a horizontal plate underlying the main section of the filter.

The flexible mesh can be used in other ways in conjunction with the main section 12. In one embodiment, the mesh is shaped into a generally boxed configuration. See FIG. 21. Here the flexible mesh is indicated generally by the numeral 260. In this embodiment, the plate 252 is elevated and forms the top of the box-type configuration. Screws or bolt assemblies are utilized to elevate the plate 252 above the bottom 52 of the storm drain. Even in this embodiment there is a depression 52A that extends underneath the plate 252. However, in this case, the flexible mesh is configured or formed into walls that depend from the plate 252 as shown in FIG. 21. The lower terminal edges of the mesh are bent or turned and secured to the bottom 52 of the storm drain 50 by bolts or screws. In this case, the main section 12 is placed above the plate 252. Again, the lower edge or bottom 20 of the main section 12 can rest directly on the plate 252 to form a generally sealed relationship.

There are numerous other situations where the flexible mesh can be utilized to effectively close areas that cannot simply be closed by placing the main section 12 directly against the side wall 54. For example, there are instances where the flanges 16 will not fit flush against the side wall 54 from top to bottom. In cases like this, sections of the flexible mesh can be secured between the side wall 54 and the flanges 16 of the main section 12. See FIG. 20. These sections of flexible mesh can be secured in various ways. As illustrated in the drawings they can be secured by bolts or screws and extend into the side wall 54 of the storm drain. In other cases portions of the flexible mesh can be coupled to the main section 12 of the filter 10 by flexible ties.

Filter 10 includes a mounting assembly indicated generally by the numeral 200 that enables the filter to be quickly and easily detachably mounted to the side wall 54 of storm drain 50. See FIGS. 16-19. The mounting assembly 200 basically comprises the flanges 16 and a pair of elongated slots 202A. In the embodiment illustrated, the flanges 16 form a part of the main section 12 of the filter 10 and the slots 202A form a part of a pair of mountain brackets indicated generally by the numeral 202. It is appreciated however that the flanges 16 and slots 202A could be reversed to where the slots 202A are incorporated into the main section 12 while the flanges 16 could form a part of a pair of mounting brackets.

In any event, as noted above, the slots 202A form a part of the pair of elongated mounting brackets 202. With reference to the drawings, particularly FIGS. 16-19, each mounting bracket 202 is elongated and includes a generally flat plate portion 202B. There is provided a series of openings 202C formed in the plate 202B that enable fasteners to be projected therethrough in order to secure the mounting brackets 202 to the side wall 54 of the storm drain 50. Also forming a part of each mounting bracket 202 is a curved or turned portion 202D. The curved or turned portion 202D of each mounting bracket 202 forms the slot 202A. In addition, each mounting bracket includes a lip 202E. As seen in the drawings the lip 202E extends from the curved or turned portion 202D and is angled away from the plate portion 202B. Therefore, it is appreciated that each mounted bracket 202 assumes a generally J-shape with the slots 202A being formed in the vicinity of the curved or turned portion 202D.

As seen in the drawings, the mounting brackets 202 are mounted in spaced apart relationship on the side wall 54 of the storm drain. The mounted brackets are particularly spaced such that when the main section 12 is mounted thereto, that the main section will be generally aligned with the outlet 58 formed in the storm drain 50. Note that the top or upper ends of the mounting brackets 202 are open. Hence, to mount the main section 12 to the mounting brackets 202, the main section is position above the mounting brackets and the flanges 16 are aligned with the slots 202A and then the main section is allowed to slide down the mounting brackets. The bottom 20 of the main section 12 will engage the bottom 52 of the storm drain or another structure such as the plate 252 discussed above and that will position the filter 10 in an operative position. It follows that the main section 12 can be easily removed from the mounting brackets 202 by simply raising or lifting the main section upwardly to a point where the flanges 16 clear the slots 202A.

In some cases, it may be necessary or appropriate to mount the mounting brackets 202 in spaced apart relationship to the side wall 54 or a portion of the side wall. In these cases the mounting brackets 202 can be set back from the side wall 54 and secured to the side wall by elongated fasteners such as bolts or screws. See FIG. 20. In this case, since this design will create an opening on opposite sides of the filter 10, it will be appropriate to mount screening material in the side spaces that exist between the side wall 54 and the main section 12. Again, as discussed above, the flexible mesh can be secured in these open areas to screen and filter water passing through such areas.

The use of "including", "comprising" or "having" and variations thereof herein is meant to encompass the items listed thereafter and equivalents thereof as well as additional items. Unless specified or limited otherwise, the terms "mounted", "connected", "supported" and "coupled" and variations thereof are used broadly and encompass direct and indirect mountings, connections, supports and couplings.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A filter for a storm drain wherein the filter is designed to be installed in the storm drain and to filter trash and debris from water passing through the storm drain, the filter comprising:

a. a perforated main section;

b. the main section being generally curve shaped and including a bottom and a top;

c. an array of openings formed in the main section for permitting water to flow through the main section;

d. wherein the main section is configured to be mounted adjacent an outlet formed in a side wall of the storm drain;

e. a flexible mesh positioned adjacent the bottom of the main section; and f. wherein the flexible mesh is generally disposed below the bottom of the main section and generally extends between a bottom of the storm drain and the bottom of the main section so as to filter trash and debris from storm water passing underneath the bottom of the main section.

2. The filter for a storm drain of claim 1 wherein the flexible mesh is secured to a plate, and wherein the plate is configured to extend over a depression in the bottom of the storm drain; and wherein the main section overlies the plate and extends upwardly therefrom.

3. The filter for a storm drain of claim 1 wherein the filter includes a plate secured to the flexible mesh.

4. The filter for a storm drain of claim 1 wherein the main section of the filter includes a pair of side flanges; a pair of mounting brackets for mounting the main section adjacent a side wall of the storm drain; each mounting bracket being elongated and configured to mount to the side wall of the storm drain, and wherein each mounting bracket includes an elongated slot that is configured to receive one side flange of the main section such that the main section can be mounted adjacent the side wall by inserting the side flanges into the slots of the mounting brackets and sliding the main section downwardly to a selected position, and wherein the main section can be removed from the mounting brackets by sliding the main section upwardly to a point where the side flanges of the main section clear the mounting brackets.

5. The filter for a storm drain of claim 4 wherein each mounting bracket assumes a generally J-shape.

6. The filter for a storm drain of claim 4 wherein each mounting bracket includes a generally flat plate that is configured to fit adjacent the side wall of the storm drain and a curved portion that extends from the flat plate portion and at least partially overlaps the flat plate portion to form the slot.

7. The filter for a storm drain of claim 6 including a lip that forms a terminal edge of the curved portion of each mounting bracket, and wherein the lip is slightly angled outwardly away from the flat plate portion to facilitate inserting the flanges in the slots of the mounting brackets.

8. The filter for a storm drain of claim 1 including a generally horizontal member supported above the bottom of the storm drain adjacent the outlet of the storm drain, and wherein the flexible mesh is secured to the horizontal member and drapes downwardly therefrom where a lower edge of the flexible mesh can be secured to the bottom of the storm drain; and wherein the main section is disposed above the horizontal member.

9. The filter for a storm drain of claim 8 wherein the bottom of the main section is supported on the horizontal member.

10. The filter for a storm drain of claim 8 wherein the horizontal member is a horizontal plate that is supported above the bottom of the storm drain by a plurality of fasteners that project up from the bottom of the storm drain.

11. A storm drain and a filter for filtering trash and debris from water passing through the storm drain, comprising:

a. an inlet for permitting water, trash and debris to enter the storm drain;

b. a side wall extending around at least a portion of the storm drain;

c. an outlet for receiving water from the storm drain, the outlet formed in the side wall of the storm drain; and d. a bottom forming a part of the storm drain and including a depression formed in the bottom for channeling water towards the outlet;

e. a storm drain filter for filtering trash and debris and generally preventing the trash and debris from entering the outlet in the side wall of the storm drain, the filter being mounted in the storm drain adjacent the outlet and comprising:

i. a main section having a series of openings for permitting water to pass therethrough;

ii. the main section including a top and a bottom;

iii. wherein the bottom of the filter extends over at least a portion of the depression such that an open space is formed between the bottom of the filter and the depression;

iv. a flexible mesh disposed adjacent the bottom of the filter;

v. a portion of the flexible mesh extending downwardly into the depression for screening at least a portion of the water flowing in the depression towards the outlet; and vi. fasteners for securing the flexible mesh to the bottom of the storm drain.

12. The storm drain and filter of claim 11 further including a plate secured to the flexible mesh and extending at least partially over the depression.

13. The storm drain and filter of claim 11 wherein the bottom of the main section is supported on the plate, and wherein the flexible mesh extends downwardly from the plate into the depression.

14. The storm drain and filter of claim 11 further including a pair of mounting brackets for mounting the main section to the side wall of the storm drain, each mounting bracket being elongated and configured to mount to the side wall of the storm drain, and wherein each mounting bracket includes an elongated slot configured to receive one side flange that forms a part of the main section such that the main section can be slidably mounted to the side wall by inserting the flanges into the slots of the mounting brackets and sliding the main section downwardly into an operative position.

15. The storm drain and filter of claim 11 including a mounting assembly for mounting the main section to the side wall, the mounting assembly includes means for mounting the filter to the side wall and permitting the filter to slide into and out of an operative position, the means for mounting the filter including a pair of flanges and a pair of elongated slots for receiving the flanges.

16. The storm drain and filter of claim 15 wherein the pair of flanges forms a part of the main section of the filter, and wherein each elongated slot forms a part of a mounting bracket that is configured to be mounted to the side wall of the storm drain.

17. A filter system for filtering water passing through a storm drain having a bottom, a sidewall and an outlet formed in the sidewall, the filter system comprising:

a. a molded plastic main section;

b. an array of openings formed in the main section for permitting water to flow through the main section and into the outlet of the storm drain;

c. the main section configured to be mounted adjacent the sidewall of the storm drain and generally aligned with the outlet formed in the sidewall of the storm drain;

d. wherein the molded plastic main section includes a depression formed therein such that when the main section is mounted adjacent the sidewall of a storm drain that there is an open area defined between a portion of the main section and the sidewall of the storm drain;

e. a flexible mesh forming a part of the filter and cooperative with the main section to filter trash and debris from water passing through the storm drain into the outlet;

f. the flexible mesh disposed adjacent the main section of the filter system for filtering one or more streams of water that bypass the main section and which is headed towards the outlet; and g. the flexible mesh being generally disposed between the main section of the filter system and a surface of the storm drain.

18. The filter system of claim 17 wherein the flexible mesh extends from at least one edge flange formed in the main section.

19. The filter system of claim 17 wherein the flexible mesh is disposed below a bottom of the main section or is disposed adjacent at least one side of the main section.

* * * * *